US008206243B2

(12) United States Patent
Stites

(10) Patent No.: US 8,206,243 B2
(45) Date of Patent: Jun. 26, 2012

(54) GOLF CLUBS AND GOLF CLUB HEADS HAVING A MOVABLE WEIGHT

(75) Inventor: John T. Stites, Weatherford, TX (US)

(73) Assignee: Nike, Inc., Beaverton, OR (US)

( * ) Notice: Subject to any disclaimer, the term of this patent is extended or adjusted under 35 U.S.C. 154(b) by 47 days.

(21) Appl. No.: 12/548,072

(22) Filed: Aug. 26, 2009

(65) Prior Publication Data

US 2011/0053705 A1 Mar. 3, 2011

(51) Int. Cl.
*A63B 53/06* (2006.01)

(52) U.S. Cl. ..... 473/334; 473/345

(58) Field of Classification Search ..... 473/334–339, 473/345

See application file for complete search history.

(56) References Cited

U.S. PATENT DOCUMENTS

| | | | | |
|---|---|---|---|---|
| 3,749,408 | A * | 7/1973 | Mills | 473/336 |
| 5,935,020 | A * | 8/1999 | Stites et al. | 473/345 |
| 6,277,032 | B1 * | 8/2001 | Smith | 473/336 |
| 6,641,490 | B2 | 11/2003 | Ellemor | |
| 7,147,573 | B2 | 12/2006 | DiMarco | |
| 7,166,041 | B2 | 1/2007 | Evans | |
| 2006/0172821 | A1 | 8/2006 | Evans | |
| 2006/0178228 | A1 * | 8/2006 | DiMarco | 473/334 |
| 2006/0240908 | A1 | 10/2006 | Adams et al. | |
| 2007/0265108 | A1 | 11/2007 | Lin et al. | |
| 2008/0261715 | A1 * | 10/2008 | Carter | 473/291 |

FOREIGN PATENT DOCUMENTS

| | | |
|---|---|---|
| JP | 2003-038689 | 2/2003 |
| WO | 2007/101350 | 9/2007 |

OTHER PUBLICATIONS

International Search Report and Written Opinion issued in corresponding PCT/US2010/045970 mailed Dec. 20, 2010.

International Preliminary Report on Patentability issued in corresponding International Application No. PCT/US2010/045970, dated Feb. 28, 2012.

* cited by examiner

*Primary Examiner* — Stephen L. Blau
(74) *Attorney, Agent, or Firm* — Banner & Witcoff, Ltd

(57) ABSTRACT

A golf club head includes a wood type golf club head body having a ball striking face portion, a rear end portion opposite the ball striking face portion, a crown or top portion, a sole or bottom portion, a toe end portion, and a heel end portion. Further, the golf club head includes a moveable weight member, which may be contained internally within the golf club head body so that the moveable weight member is not exposed. Also, the club head may include a track system contained internally within the golf club head body so that the track system is not exposed. The track system includes a track which extends around the interior of one or more walls that comprise the golf club head body and the moveable weight member moves around the interior of the golf club head by sliding in the track.

17 Claims, 23 Drawing Sheets

GOLF CLUBS AND GOLF CLUB HEADS HAVING A MOVABLE WEIGHT

FIELD OF THE INVENTION

The present disclosure relates to golf clubs and golf club heads. Particular example aspects of this disclosure relate to golf clubs and golf club heads having a movable weight.

BACKGROUND

Golf is enjoyed by a wide variety of players—players of different genders and dramatically different ages and/or skill levels. Golf is somewhat unique in the sporting world in that such diverse collections of players can play together in golf events, even in direct competition with one another (e.g., using handicapped scoring, different tee boxes, in team formats, etc.), and still enjoy the golf outing or competition. These factors, together with the increased availability of golf programming on television (e.g., golf tournaments, golf news, golf history, and/or other golf programming) and the rise of well known golf superstars, at least in part, have increased golf's popularity in recent years, both in the United States and across the world.

Golfers at all skill levels seek to improve their performance, lower their golf scores, and reach that next performance "level." Manufacturers of all types of golf equipment have responded to these demands, and in recent years, the industry has witnessed dramatic changes and improvements in golf equipment. For example, a wide range of different golf ball models now are available, with balls designed to complement specific swing speeds and/or other player characteristics or preferences, e.g., with some balls designed to fly farther and/or straighter; some designed to provide higher or flatter trajectories; some designed to provide more spin, control, and/or feel (particularly around the greens); some designed for faster or slower swing speeds; etc. A host of swing and/or teaching aids also are available on the market that promise to help lower one's golf scores.

Being the sole instrument that sets a golf ball in motion during play, golf clubs also have been the subject of much technological research and advancement in recent years. For example, the market has seen dramatic changes and improvements in putter designs, golf club head designs, shafts, and grips in recent years. Additionally, other technological advancements have been made in an effort to better match the various elements and/or characteristics of the golf club and characteristics of a golf ball to a particular user's swing features or characteristics (e.g., club fitting technology, ball launch angle measurement technology, ball spin rates, etc.).

While the industry has witnessed dramatic changes and improvements to golf equipment in recent years, some players continue to experience difficulties in reliably hitting a golf ball in an intended and desired direction and/or with an intended and desired flight path. Accordingly, there is room in the art for further advances in golf club technology.

SUMMARY

The following presents a general summary of aspects of the disclosure in order to provide a basic understanding and various aspects of the disclosure. This summary is not intended to limit the scope of the disclosure in any way, but it simply provides a general overview and context for the more detailed description that follows.

Aspects of this invention relate to golf club heads comprising a wood type golf club head body including a ball striking face portion, a rear end portion opposite the ball striking face portion, a crown or top portion, a sole or bottom portion, a toe end portion, and a heel end portion. Further, the golf club heads include a moveable weight member contained internally within the golf club head body so that the moveable weight member is not exposed and a track system contained internally within the golf club head body so that the track system is not exposed. The track system includes a track which extends around the interior of one or more walls that comprise the golf club head body and the moveable weight member moves around the interior of the golf club head by sliding in the track.

Other aspects of this invention relate to golf club heads comprising a wood type golf club head body including a ball striking face portion, a rear end portion opposite the ball striking face portion, a crown or top portion, a sole or bottom portion, a toe end portion, and a heel end portion. Further, the golf club heads include at least two moveable weight members contained internally within the golf club head body so that the moveable weight members are not exposed and a track system contained internally within the golf club head body so that the track system is not exposed. The track system includes a track which extends around the interior of one or more walls that comprise the golf club head body and the moveable weight members move independently from each other around the interior of the golf club head by sliding in the track.

Additional aspects of this disclosure relate to wood-type golf club structures that include golf club heads, e.g., of the types described above. Such golf club structures further may include one or more of: a shaft member attached to the club head (optionally via a separate hosel member or a hosel member provided as an integral part of one or more of the club head or shaft); a grip or handle member attached to the shaft member; weighting members; etc.

Still additional aspects of this disclosure relate to methods for producing golf club heads and golf club structures, e.g., of the types described above. Such methods may include, for example: (a) providing a golf club head of the various types described above, e.g., by manufacturing or otherwise constructing the golf club head body, by obtaining the golf club head body from another source, etc.; and (b) engaging a shaft member with the golf club head body at a separate hosel member or a hosel member provided as an integral part of one or more of the club head or shaft.

Methods according to examples of this disclosure may include additional steps, such as engaging a grip member with the shaft member; engaging weights with the club head body; moving weights with respect to the club head body; etc. Other steps also may be included in these methods, such as club head body finishing steps, etc.

BRIEF DESCRIPTION OF THE DRAWINGS

The present invention is illustrated by way of example and not limited in the accompanying figures, in which like reference numerals indicate similar elements throughout, and in which.

Figure 1:
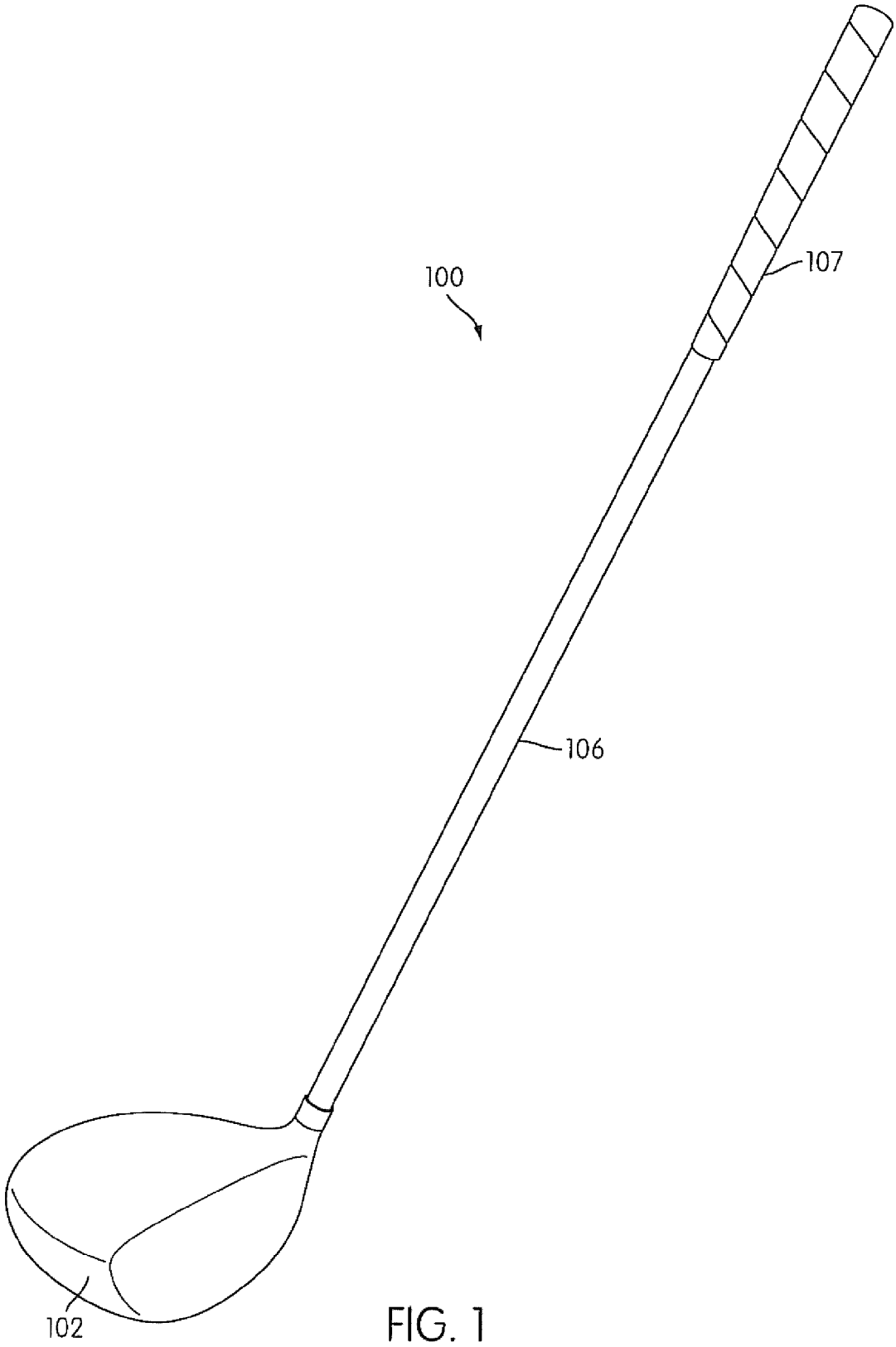
FIG. 1 is an illustrative embodiment of a golf club according to at least some aspects of this disclosure.

The reader is advised that the various parts shown in these drawings are not necessarily drawn to scale.

DETAILED DESCRIPTION

The following description and the accompanying figures disclose features of golf club heads and golf clubs in accordance with examples of the present disclosure.

I. GENERAL DESCRIPTION OF EXAMPLE GOLF CLUB HEADS, GOLF CLUBS, AND METHODS IN ACCORDANCE WITH THIS INVENTION

As described above, some players experience difficulty in reliably hitting a golf ball in an intended and desired direction and/or with an intended and desired flight path. Therefore, aspects of the disclosure are directed to golf club heads that include a moveable weight which can be positioned to aid a player in reliably hitting the ball in an intended and desired direction and/or with an intended and desired flight path. Particular aspects of the disclosure are directed to golf club head bodies wherein the movable weight is contained internally within the golf club head body so that it is not exposed. According to some aspects of the disclosure, the position of the moveable weight within the golf club head body aids the golf club head in imparting a particular trajectory to a golf ball when the golf club head strikes the golf ball.

For example, according to aspects of this disclosure, the movable weight can be positioned towards the heel of the golf club head body. Such a configuration may help a golfer who has a tendency to "slice." A "slice" is an errant golf shot in which the ball curves a direction away from the side from which it was struck. For example, for a right handed golfer, a slice will cause the golf ball to curve to the right. Positioning the movable weight towards the heel of the golf club head body distributes more of the mass of the golf club head towards the heel which can help slow the heel during a swing as compared with the toe of the golf club head. This will allow the golfer to better square the club head during the swing, which may result in less "slice" (i.e., a straighter trajectory). According to particular example aspects of this disclosure, the moveable weight is positioned in a heel side of the club head (with respect to a centerline running perpendicular to the ball striking face and through the club head's geometric center in the front-to-rear direction). This positioning redistributes the mass of the golf club head body so that more mass is in the heel side of the golf club head and, therefore, the above described advantages are achieved.

Conversely, according to aspects of this disclosure, the movable weight can be positioned towards the toe of the golf club head body. Such a configuration may help a golfer who has a tendency to "hook." A "hook" is an errant golf shot in which the ball curves a direction towards the side from which it was struck. For example, for a right handed golfer, a slice will cause the golf ball to curve to the left. Positioning the movable weight towards the toe of the golf club head body distributes more of the mass of the golf club head toward the toe which can help slow the toe during a swing as compared with the heel of the golf club head. This will allow the golfer to better square the club head during the swing, which may result in less of a "hook" (i.e., a straighter trajectory). According to particular example aspects of this disclosure, the moveable weight is positioned in a toe side of the club head (with respect to a centerline running perpendicular to the ball striking face and through the club head's geometric center in the front-to-rear direction). This positioning redistributes the mass of the golf club head body so that more mass is in the toe side of the golf club head and, therefore, the above described advantages are achieved.

According to another aspect of this disclosure, the moveable weight can be positioned towards the rear and (optionally towards the sole, or bottom) of the golf club head body. Such a configuration may help a golfer achieve a higher trajectory. A common problem that many golfers experience, especially those just learning to play, is not being able to reliably get the ball in the air or achieving a desired trajectory. Positioning the moveable weight towards the rear and/or toward the bottom of the golf club head distributes more mass of the golf club head towards the rear portion and (optionally towards the sole, or bottom) which keeps more of the weight of the golf club head body rearward and low. This will aid the golfer in getting the ball airborne upon striking the ball with the club head resulting in a higher trajectory.

As described above, the moveable weight can be positioned within the golf club head body to bias the trajectory of the golf ball when it is struck by the golf club head. For example, a draw or fade biased trajectory or higher trajectory can be achieved. A "fade" is a golf shot in which the ball trajectory gently curves in a direction away from the side from which it was struck. Conversely, a "draw" is a golf shot in which the ball trajectory gently curves in a direction toward the side from which it was struck.

Aspects of this disclosure relate to wood-type golf club heads. Wood-type golf club heads according to at least some example aspects of this disclosure may include: (a) a wood-type golf club head body; (b) a ball striking face portion (including a ball striking face plate integrally formed with the ball striking face portion or attached to a frame member such that the face plate and frame portion together constitute the overall ball striking face portion); (c) a rear portion opposite the ball striking face; (d) a toe end portion; and (e) a heel end portion. The golf club head body may include one or more moveable weights to impart a desired biased trajectory to the golf ball when it is struck by the golf club head. The club head body itself also may be constructed in any suitable or desired manner and/or from any suitable or desired materials without departing from this disclosure, including from conventional materials and/or in conventional manners known and used in the art.

Wide varieties of overall club head constructions are possible without departing from this disclosure. For example, if desired, some or all of the various individual parts of the club head body may be made from multiple pieces that are connected together (e.g., by adhesives or cements; by welding, soldering, brazing, or other fusing techniques; by mechanical connectors; etc.). The various parts (e.g., top portion, sole portion, cup face, aft body, crown member, body ribbon members, etc.) may be made from any desired materials and combinations of different materials, including materials that are conventionally known and used in the art, such as metal materials, including lightweight metal materials (e.g., titanium, titanium alloys, aluminum, aluminum alloys, magnesium, magnesium alloys, etc., composite materials, polymer materials, etc. The club head body and/or its various parts may be made by forging, casting, molding, and/or using other techniques and processes, including techniques and processes that are conventional and known in the art.

For golf club structures according to this disclosure, the overall wood-type golf club structure may include a hosel region, a shaft member received in and/or inserted into and/or through the hosel region, and a grip or handle member attached to the shaft member. Optionally, if desired, the external hosel region may be eliminated and the shaft member may be directly inserted into and/or otherwise attached to the head member (e.g., through an opening provided in the top of the club head, through an internal hosel member (e.g., provided within an interior chamber defined by the club head), etc.). The hosel member may be integrally formed as part of the club head structure, or it may be separately formed and engaged therewith (e.g., by adhesives or cements; by welding, brazing, soldering, or other fusing techniques; by mechanical connectors; etc.). Conventional hosels and their inclusion in a wood-type club head structure may be used without departing from this disclosure.

The shaft member may be received in, engaged with, and/or attached to the club head in any suitable or desired manner, including in conventional manners known and used in the art, without departing from the disclosure. As more specific examples, the shaft member may be engaged with the club head via a hosel member and/or directly to the club head structure, e.g., via adhesives, cements, welding, soldering, mechanical connectors (such as threads, retaining elements, or the like), etc.; through a shaft-receiving sleeve or element extending into the club head body; etc. If desired, the shaft may be connected to the head in a releasable manner using mechanical connectors to allow easy interchange of one shaft for another.

The shaft member also may be made from any suitable or desired materials, including conventional materials known and used in the art, such as graphite based materials, composite or other non-metal materials, steel materials (including stainless steel), aluminum materials, other metal alloy materials, polymeric materials, combinations of various materials, and the like. Also, the grip or handle member may be attached to, engaged with, and/or extend from the shaft member in any suitable or desired manner, including in conventional manners known and used in the art, e.g., using adhesives or cements; via welding, soldering, brazing, or the like; via mechanical connectors (such as threads, retaining elements, etc.); etc. As another example, if desired, the grip or handle member may be integrally formed as a unitary, one-piece construction with the shaft member. Additionally, any desired grip or handle member materials may be used without departing from this disclosure, including, for example: rubber materials, leather materials, rubber or other materials including cord or other fabric material embedded therein, polymeric materials, cork materials, and the like.

Still other additional aspects of this disclosure relate to methods for producing wood-type golf club heads and wood-type golf club structures in accordance with examples of this disclosure. Such methods may include, for example, one or more of the following steps in any desired order and/or combinations: (a) providing a wood-type golf club head body and/or a golf club head of the various types described above (including any or all of the various structures, features, and/or arrangements described above), e.g., by manufacturing or otherwise constructing the golf club head body or the golf club head, by obtaining it from a third party source, etc.; (b) engaging a shaft member with the golf club head; (c) engaging a grip member with the shaft member; etc.

Given the general description of various example aspects of the disclosure provided above, more detailed descriptions of various specific examples of golf clubs and golf club head structures according to the disclosure are provided below.

II. DETAILED DESCRIPTION OF EXAMPLE GOLF CLUB HEADS, GOLF CLUB STRUCTURES, AND METHODS ACCORDING TO THE INVENTION

The following discussion and accompanying figures describe various example golf clubs and golf club head structures in accordance with the present disclosure. When the same reference number appears in more than one drawing, that reference number is used consistently in this specification and the drawings to refer to the same or similar parts throughout.

An illustrative embodiment according to one or more aspects of the disclosure is shown in FIG. 1. FIG. 1 shows a golf club 100 at the address position which includes a wood-type golf club head 102 in accordance with aspects of this disclosure and a shaft 106 and grip 107 engaged with the wood-type golf club head 102. According to some aspects of the disclosure, the dimensions of the club head body 102 may include a volume between 100-500 cubic centimeters (e.g., 460 cubic centimeters) and a mass between 75 and 250 grams (e.g., 150 grams). Further, according to aspects of this disclosure, the interior of the golf club head body 102 may be substantially hollow.

Figure 2A:
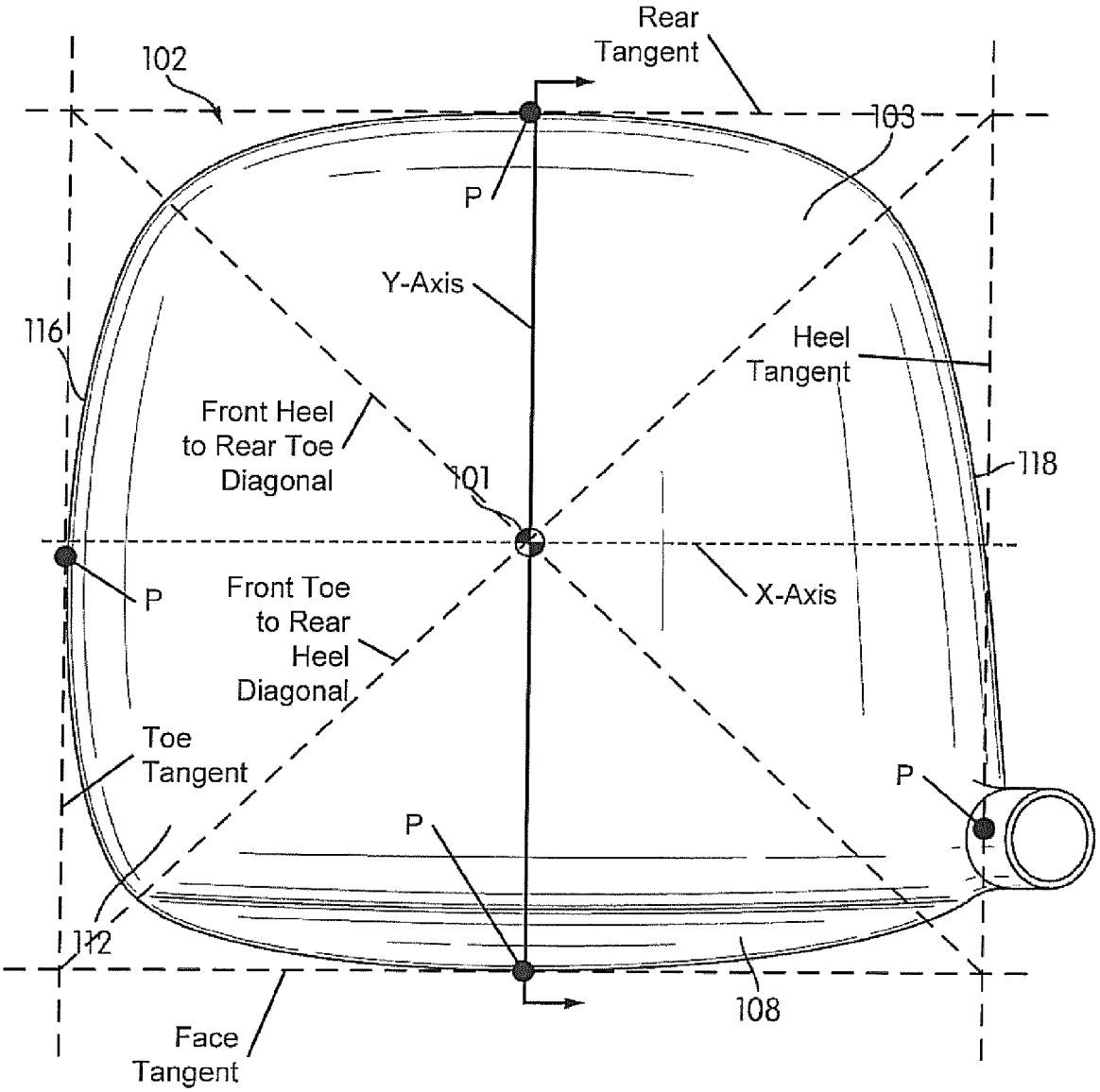
FIGS. 2A-2B generally illustrate features of golf club head structures according to at least some examples of this disclosure.

FIG. 2A illustrates a top view of the example wood-type golf club head body 102 which includes a ball striking face portion 108, a rear portion 110 opposite the ball striking face, a crown (or top) portion 112, a sole portion 114, a toe end portion 116 and a heel end portion 118. As seen in FIG. 2A, the geometric center of the golf club head is denoted symbolically by reference numeral 101. In this specification, various features and aspects of the invention are defined based on geometry and locations with respect to a golf club head. As used in this specification and as illustrated with respect to FIG. 2A, the location of the "geometric center" 101 of a wood type golf club head 102 is determined in the following manner, which is consistent with the manner in which various club head dimensions are determined in Appendix II of *The* 2008-2009 *Rules of Golf*, as promulgated by the United States Golf Association ("U.S.G.A."), which rules are entirely incorporated herein by reference. First, with the golf club head 102 oriented at its designed lie angle (the lie angle of its specifications, e.g., 60°), the outermost points P of the heel, toe, face, and rear of the club head 102 are determined. If the outermost point of the heel is not clearly defined (e.g., due to the club head's hosel, etc.), then the outermost point of the heel is deemed to be the location on the heel at 0.875 inches (22.23 mm) above the horizontal plane on which the club head is lying, in the same manner as the heel location is determined under *The Rules of Golf* mentioned above. Vertical projections along the outermost points P of the front, toe, rear, and heel (shown as "tangents" in the overhead view of FIG. 2A) enclose the club head 102 within a rectangle or square structure, as shown in FIG. 2A (all angles being right angles). Then, a first diagonal line is drawn from the front heel corner to the rear toe corner of the rectangle or square structure (labeled "Front Heel to Rear Toe Diagonal" in FIG. 2A), and a second diagonal line is drawn from the front of the toe corner to the rear heel corner of the rectangle or square structure (labeled "Front Toe to Rear Heel Diagonal" in FIG. 2A). The intersection of these two diagonals D is deemed to be the "geometric center" 101 of the club head 102 as that term is used in this specification.

If necessary to provide a frame of reference, the front vertical projection or tangent line will be oriented square to the club head target line or direction at the outermost point P of the face surface, and then the heel and toe projections or tangents may be provided (at their outermost points) perpendicular to the front projection or tangent and the rear projection or tangent may be provided (at its outermost point) parallel to the front projection or tangent. An XY "coordinate axis" may be defined for the club head 102 by drawing a first coordinate axis (the Y-axis) in the front-to-rear direction perpendicular to the front and rear tangents through the geometric center 101 of the club head 102 and by drawing a second coordinate axis (the X-axis) in the heel-to-toe direction perpendicular to the first coordinate axis (and perpendicular to the heel and toe tangents) through the geometric center 101 of the club head body 102.

Figure 2B:
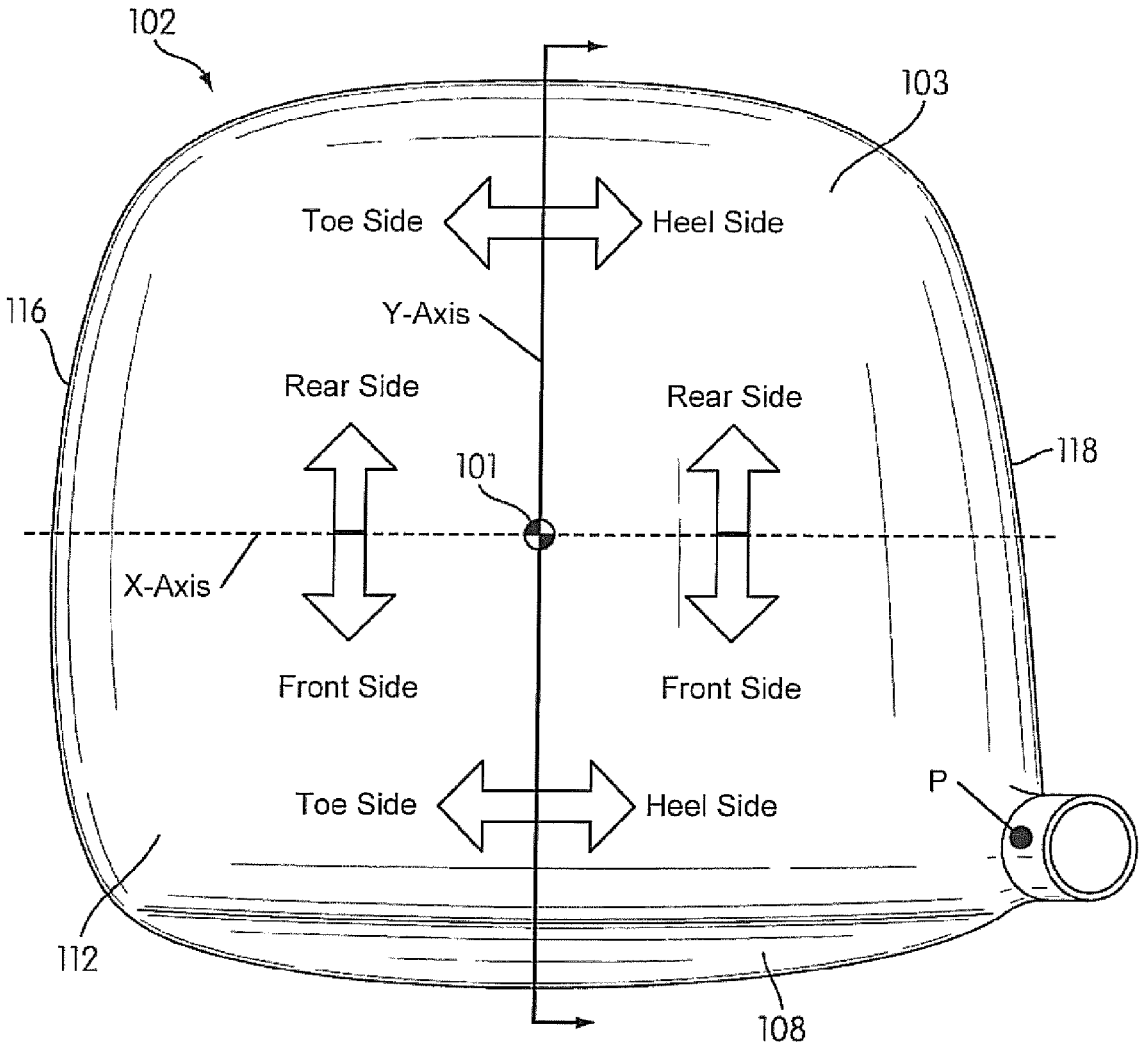

As shown in FIG. 2B, the "heel side" of the club head, as used in this specification, is defined as everything toward the heel 118 from the front-to-back Y coordinate axis. The "toe side" of the club head, as used in this specification, is defined as everything toward the toe 116 from the front-to-back Y coordinate axis. The "front side" of the club head, as used in this specification, is defined as everything forward of the heel-to-toe X coordinate axis. The "rear side" of the club head, as used in this specification, is defined as everything rearward of the heel-to-toe X coordinate axis.

Figure 3A:
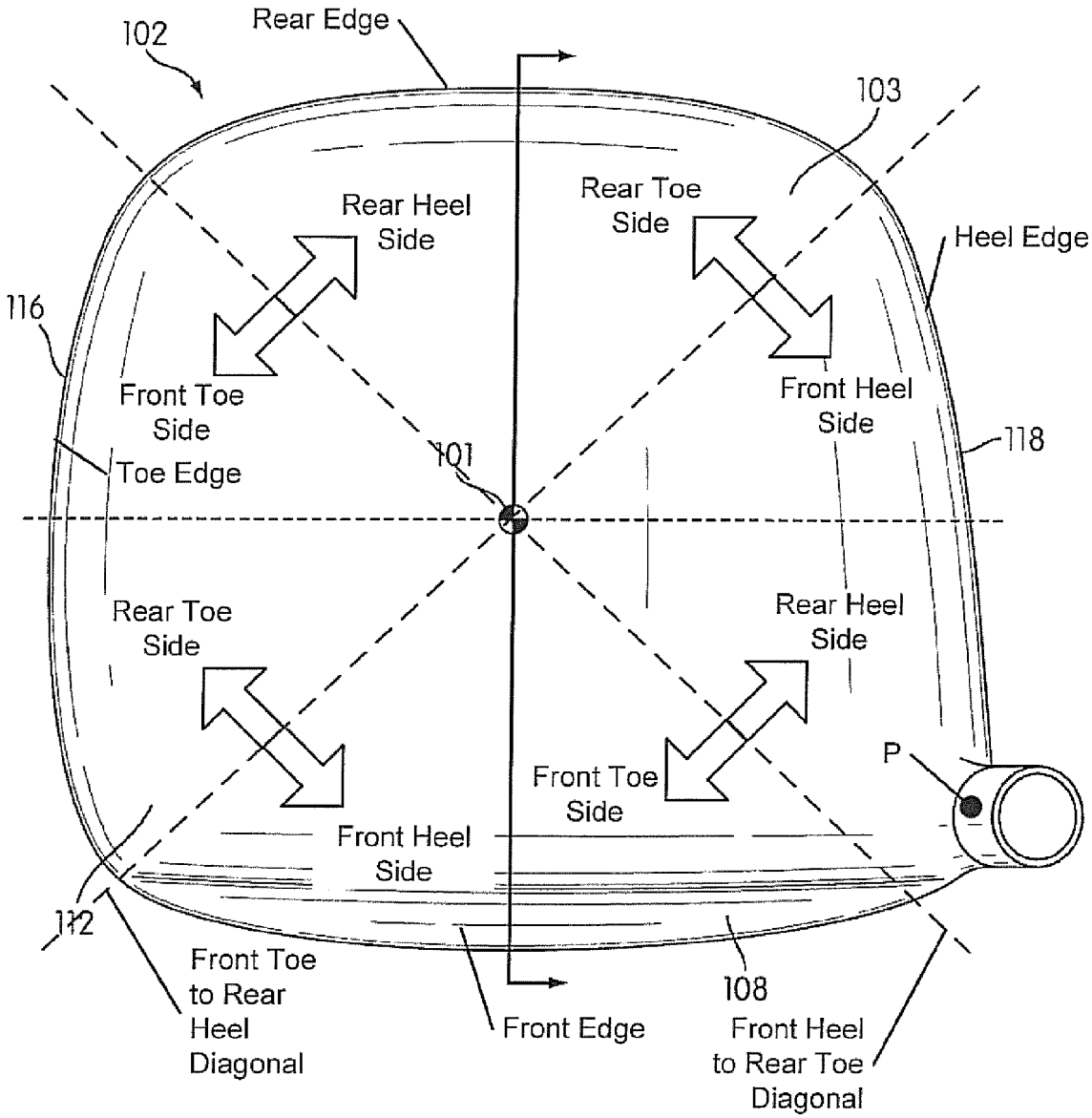
FIGS. 3A-3B generally illustrate features of golf club head structures according to at least some examples of this disclosure.

As shown in FIG. 3A, the "rear heel side" of the club head, as used in this specification, is everything toward the rear side and heel side from the front heel to rear toe diagonal. The "rear toe side" of the club head, as used in this specification, is everything toward the rear side and toe side from the front toe to rear heel diagonal. The "front heel side" of the club head, as used in this specification, is everything toward the front side and heel side from the front toe to rear heel diagonal. The "front toe side" of the club head, as used in this specification, is everything toward the front side and toe side from the front heel to rear toe diagonal. The "heel edge" of the club head body is the edge surface along the heel side between the front heel to rear toe diagonal and the front toe to rear heel diagonal. The "toe edge" of the club head body is the edge surface along the toe side between the front heel to rear toe diagonal and the front toe to rear heel diagonal. The "rear edge" of the club head body is the edge surface along the rear side between the front heel to rear toe diagonal and the front toe to rear heel diagonal. The "front edge" of the club head body is the edge surface along the front side between the front heel to rear toe diagonal and the front toe to rear heel diagonal. Something located "proximate to" one of these edges, as used in this specification in this context, unless otherwise noted, means within 0.75 inches of the relevant edge.

Figure 3B:
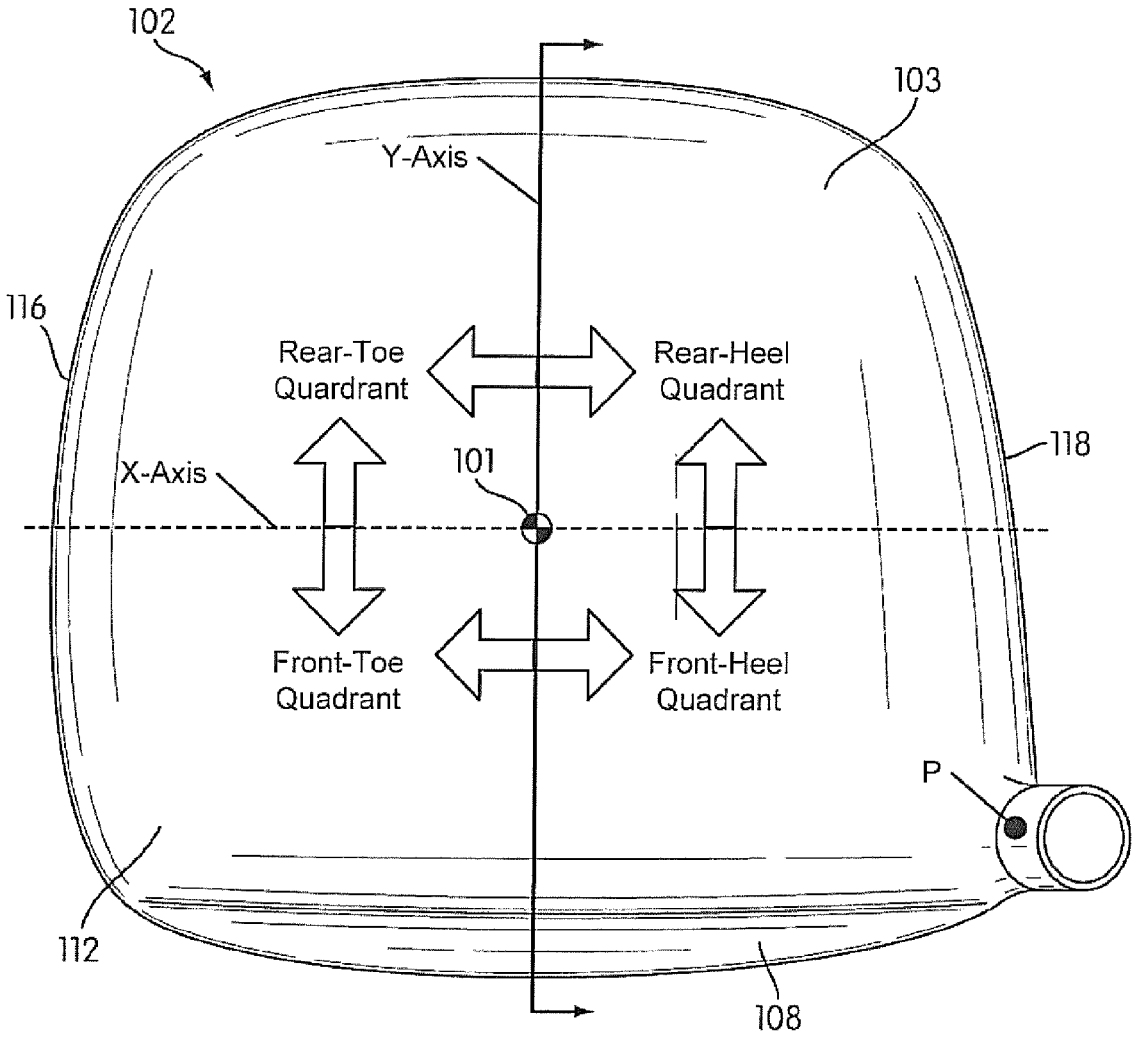

As shown in FIG. 3B, the "rear heel quadrant," "rear toe quadrant," "front toe quadrant," and "front heel quadrant" are defined using the geometric center 101 and the XY coordinate axes as described above.

While illustrated in FIGS. 2A-2B and 3A-3B on a relatively square shaped wood-type club head, these same definitions apply to more traditionally shaped wood-type golf club heads (e.g., as seen in FIGS. 1 and 4-11).

The "crown portion" of a golf club head is defined as that portion of the golf club head top surface that is visible looking directly downward on the club head when the golf club head body 102 oriented at its designed lie angle (the lie angle of its specifications, e.g., 60°). The "sole portion" of a golf club head is defined as that portion of the golf club head bottom surface that is visible looking directly upward on the club head when the golf club head body 102 oriented at its designed lie angle (the lie angle of its specifications, e.g., 60°). The topmost point of the club head crown portion and the bottommost point of the club head sole portion can be found by locating horizontal projections along the crown portion and the sole portion, respectively, with the club oriented as described above.

According to aspects of the disclosure, the golf club head may include one or more moveable weights. Further, according to aspects of the disclosure, the one or more moveable weights may be contained internally within the golf club head body 102 so that the moveable weights are not exposed nor are a portion of the exterior of the golf club head body 102. Additionally, according to some aspects of the disclosure, the one or more moveable weights may move around the interior of the golf club head via a track system contained internally within the golf club head body so that the track system is not exposed and which extends around the interior of the wall(s) that comprise the golf club head body 102.

Figure 4A:
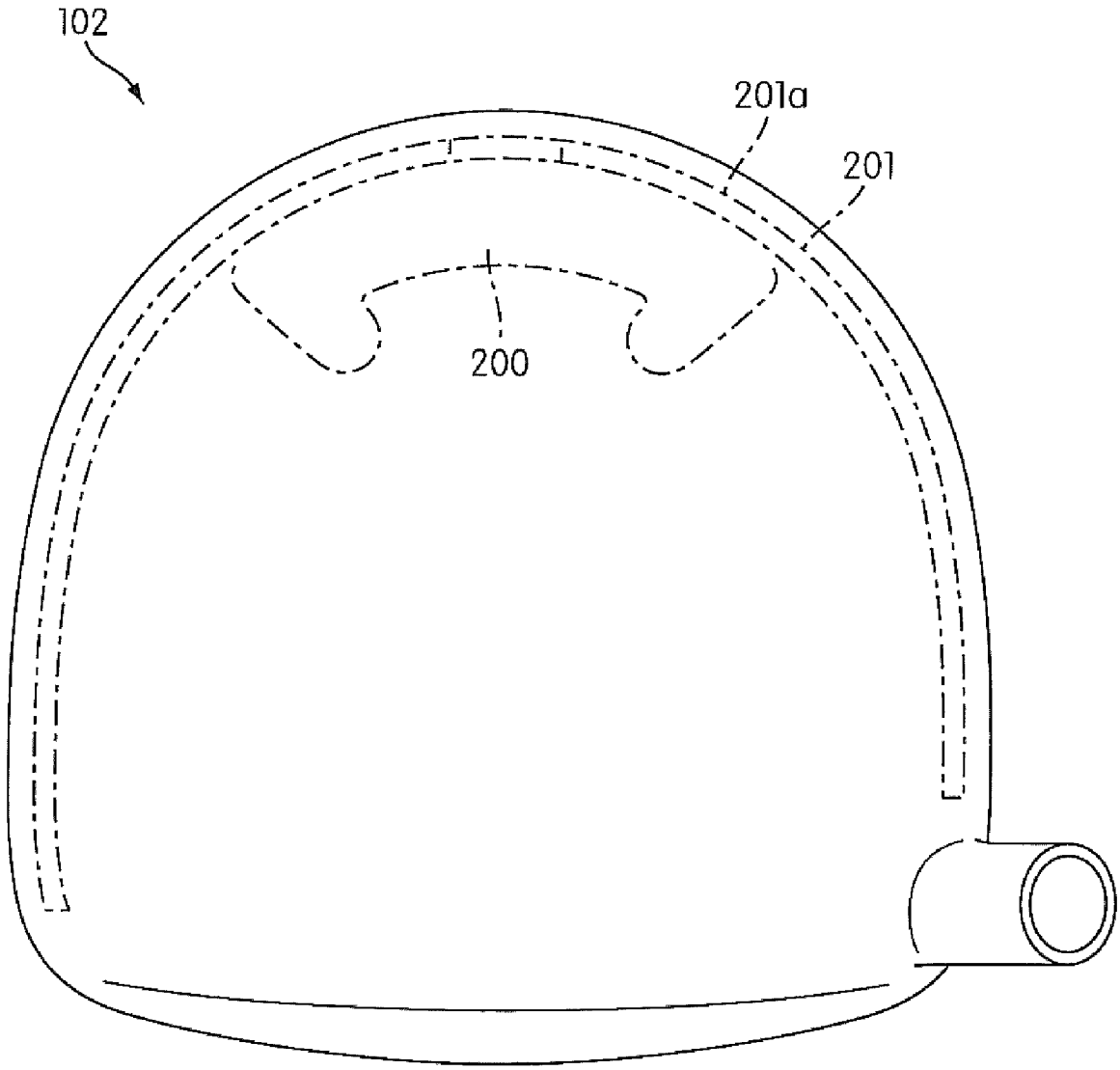
FIGS. 4A-4D are views of an illustrative embodiment of a golf club head according to at least some aspects of this disclosure.

For example, FIG. 4A shows a top view an illustrative embodiment of the golf club head body 102. As seen in phantom line in FIG. 4A, the golf club head body 102 may include therein both a moveable weight 200 and a track system 201 which extends from a heel side of the golf club head body along a rear side of the golf club head body to a toe side of the golf club head body. Further, as seen in FIG. 4A, the moveable weight 200 may slide within the track system 201 that is positioned on or in the interior walls that comprise the heel, toe and rear sides of the golf club head body 102. As mentioned above, the elements in the figures of this disclosure, such as the moveable weight 200, track system 201, etc. are shown for illustrative purposes and, therefore, may not necessarily be shown to scale.

Figure 4B:
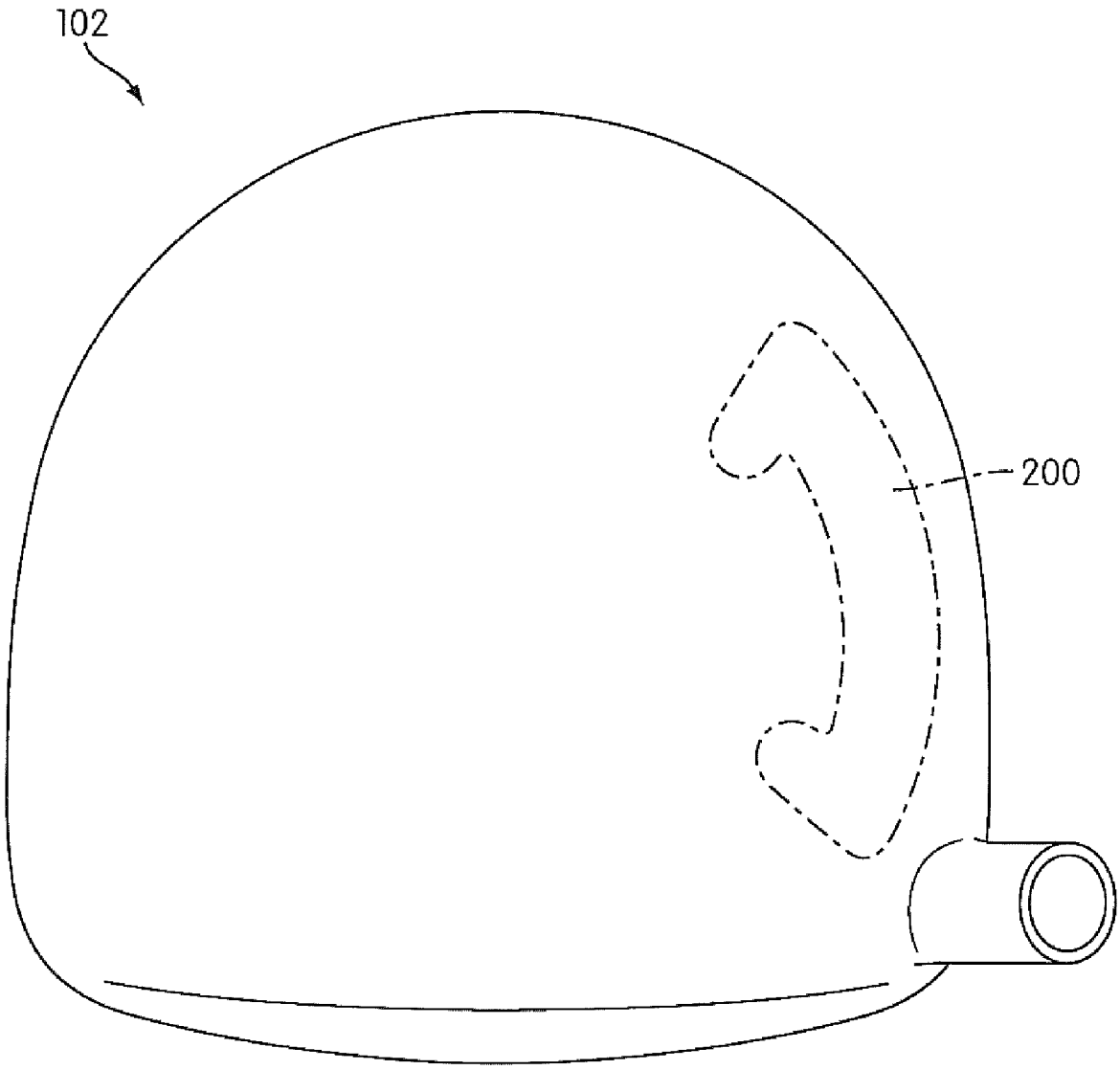
Figure 4C:
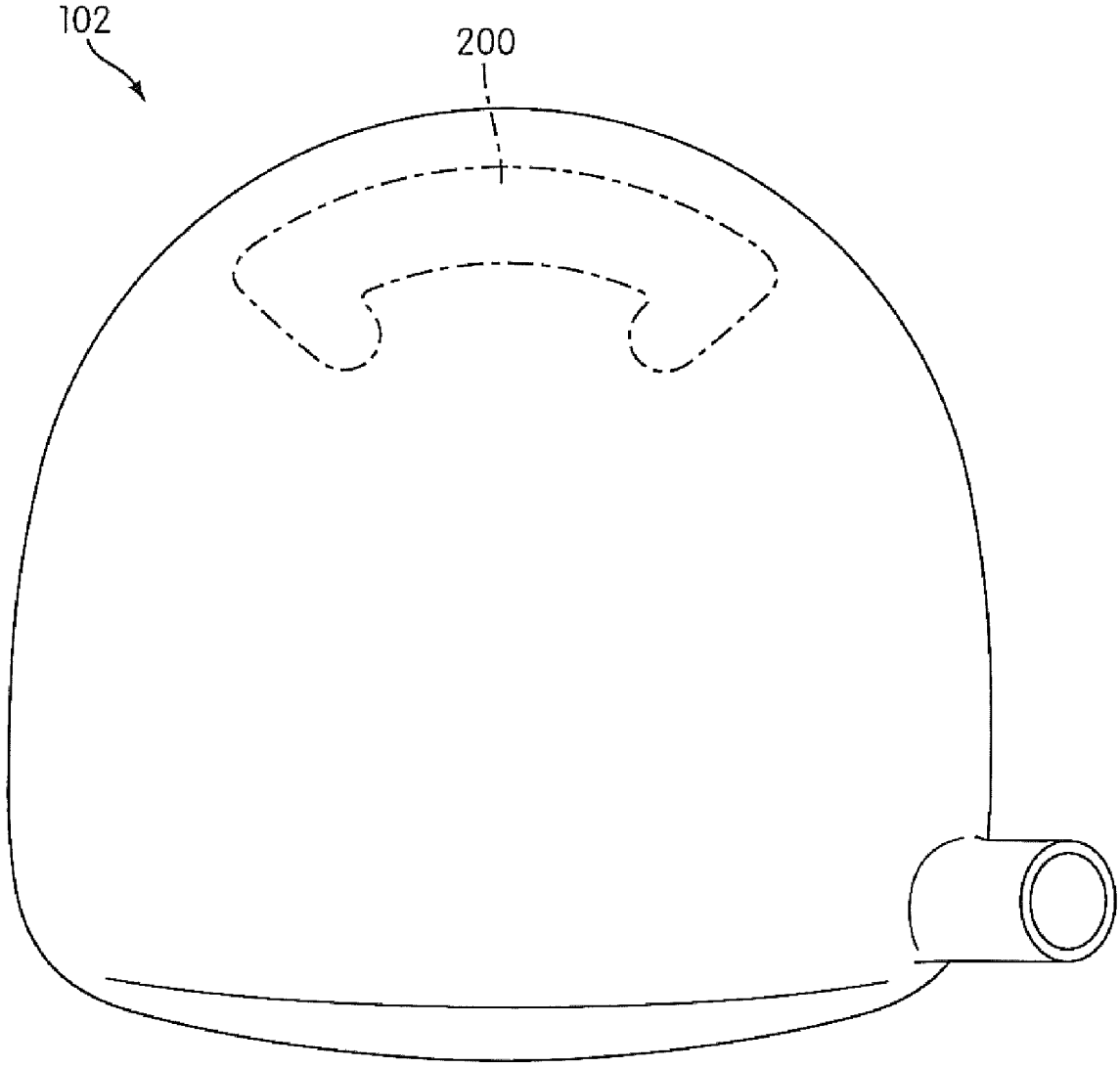
Figure 4D:
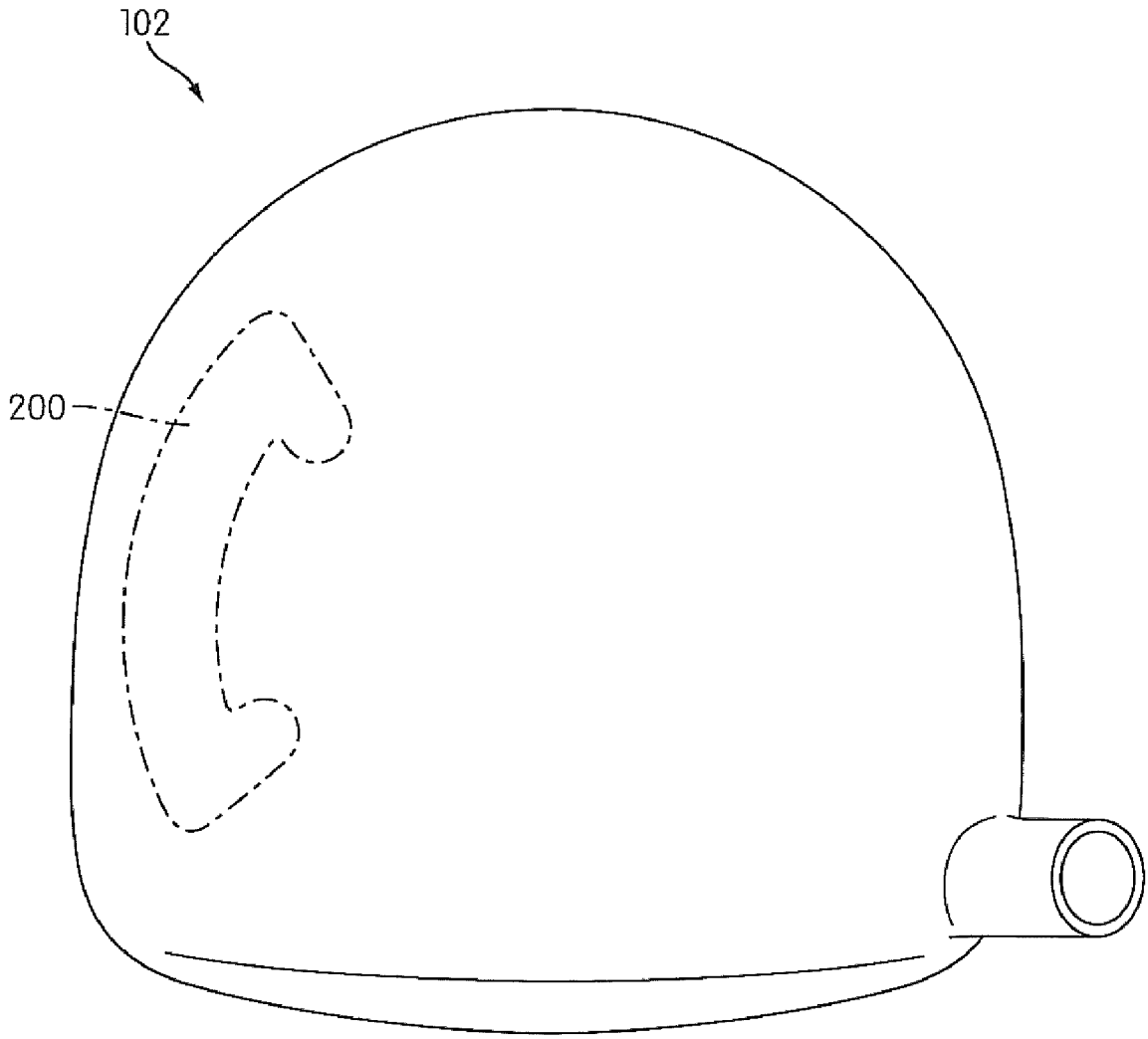

As seen schematically in FIGS. 4B-D, the moveable weight 200 may slide between a position in the heel side (see e.g., FIG. 4B) to a position in the rear side (see e.g., FIG. 4C) to a position in the toe side (see e.g., FIG. 4D) of the golf club head body 102. It is noted that while the above figures represent three possible positions of the moveable weight member 200 along the track system 201, of course, the moveable weight member 200 could be moved to other positions as well (e.g., to positions between the above described positions).

One advantage of positioning the weight member 200 and track system 201 within the interior of the golf club head 102 so as to not be exposed, is that the aerodynamics of the club head body 102 will not be affected during the golfer's swing. In other words, containing the moveable weight 200 and track system 201 within the hollow interior of the golf club head body so that neither the moveable weight 200 nor the track system 201 are exposed, eliminates the possibility that either the moveable weight 200 and track system 201 will compromise the speed, drag, or other characteristics of the golf club head body 102 that relate to aerodynamics of the golf club head body 102 during a golf swing.

Another advantage of positioning the moveable weight member 200 and track system 201 within the interior of the golf club head 102 is that such a positioning prevents the moveable weight member 200 and track system 201 from being exposed to the elements, such as rain, dirt, mud, sand, etc. Such exposure to the elements can interfere with the functioning of the moveable weight member 200 and track system 201 or even damage the moveable weight member 200 and track system 201. For example, after being used for several rounds of golf, elements such as dirt, mud, sand, etc. could become lodged in the track system 201 and prevent the moveable weight member 200 from sliding or being locked into position. Additionally, rain, moisture, etc. could cause rust or otherwise damage the moveable weight member 200 or track system 201.

Figure 5:
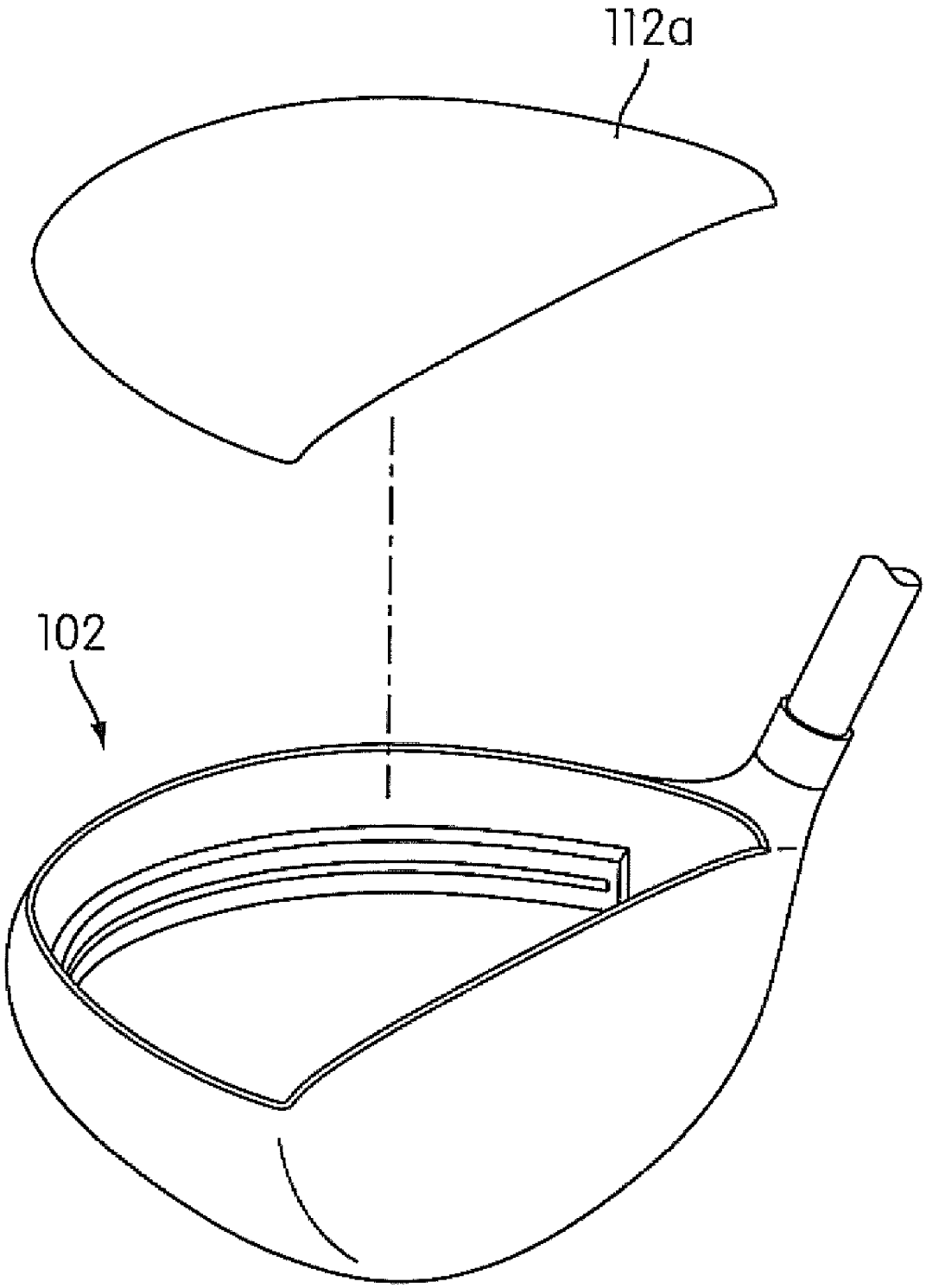
FIG. 5 is an illustrative embodiment of a golf club head according to at least some aspects of this disclosure.

The golf club head body 201 may have a removable portion which allows the golfer to access the internal weight member 200 and track system 201. For example, as seen in FIG. 5, the crown 112 may have a removable section 112*a* in the central portion of the crown 112 that may be removed to allow the golfer access to the interior of the golf club head body 102 including the movable weight member 200 and track system 201.

Figure 6:
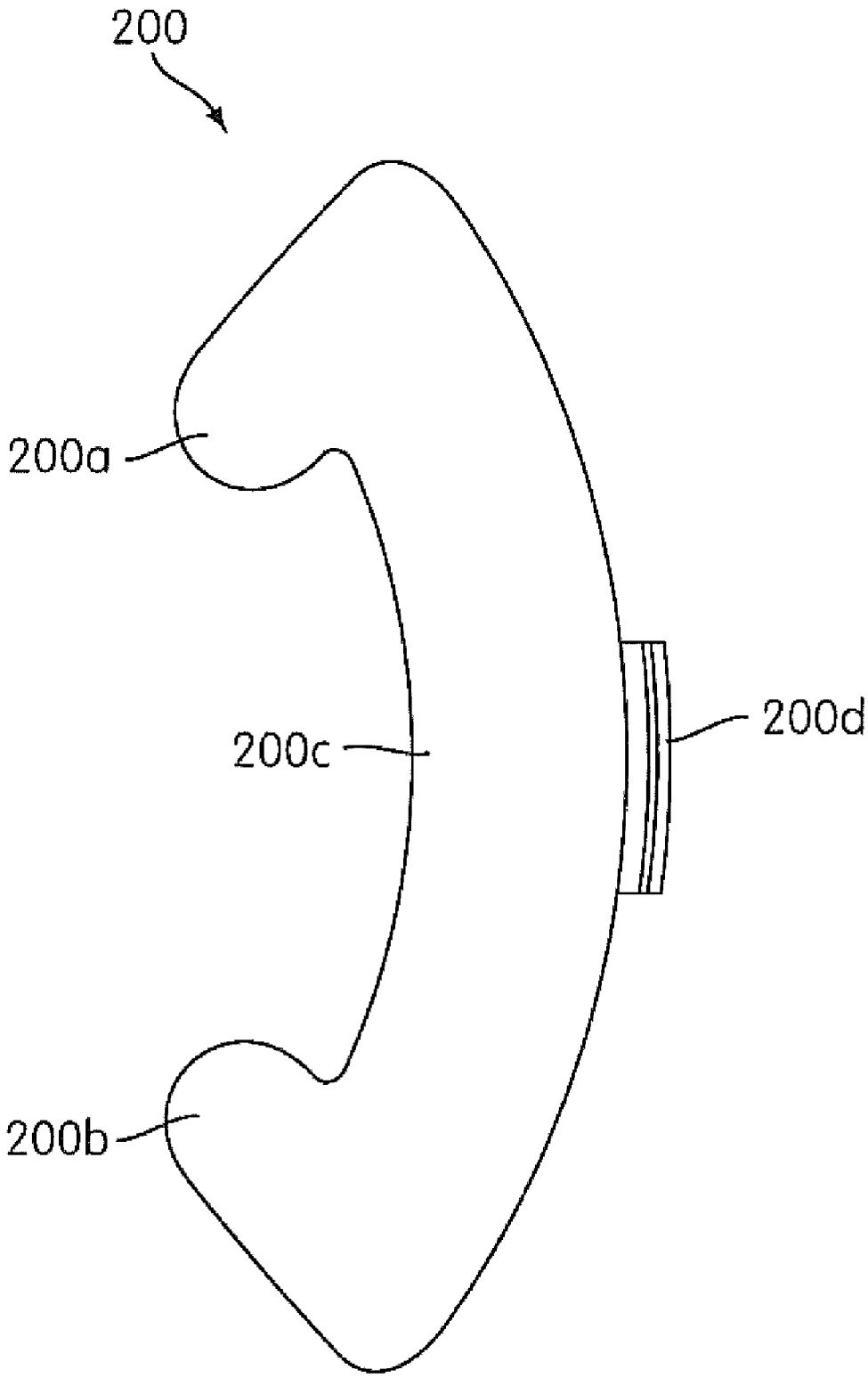
FIG. 6 is an illustrative embodiment of a moveable weight member according to at least some aspects of this disclosure.

The moveable weight member 200 may be shaped so as to correspond to the shape of the wall(s) that comprise the golf club head body 102 (e.g., as seen in FIGS. 4B-D). FIG. 6 shows a perspective view of the moveable weight member 200. As seen in FIG. 6, the moveable weight member 200 may be curved or even exhibit a "U" or "C" shape which includes a first end 200*a*, a second end 200*b*, and a middle section 200*c* that extends between the first end 200*a* and the second end 200*b*. As seen in FIG. 6, according to some embodiments of this disclosure, the moveable weight member 200 may include a rear portion 200*d* which extends along the rear of the moveable weight member 200 and is configured to engage with the track system 201. Of course, according to other embodiments, the moveable weight member 200 does not have to include the rear portion 200*d* and instead could have a different shape wherein the weight member 200 fits substantially or entirely within the track system 201. For example, the moveable weight member 200 could exhibit a generally rectangular shape.

According to some aspects of the disclosure, the moveable weight member 200 may have a height between 0.5-5.5 cm, 1.0-4.0 cm, and 2.0-2.5 cm. Further, the moveable weight member 200 may have a length between 1.25-15 cm, 5.0-13.0 cm, and 7.5-10.0 cm. Further, the moveable weight member 200 may have a depth between 1.25-6.5 cm, 2.0-5.0 cm, and 2.5-4.0 cm. Of course, due to the shape of the moveable weight member 200, the first end 200*a* and the second end 200*b* may have more depth than the middle section 200*c*. For example, the first end 200*a* and the second end 200*b* may have a depth between 5.0 cm while the middle section 200*c* has a depth of 2.0 cm. Further, the moveable weight member 200 may have a mass between 5.0-70 grams, 20-60 grams, 30-55 grams, or 50 grams. According to some aspects of this disclosure, the moveable weight member 200 has a large specific gravity, density and weight. For example, the moveable weight member 200 may have a greater specific gravity and be denser and heavier than other parts of the golf club head 102. For example, the moveable weight member 200 may be made substantially or entirely from a high density and heavy material such as various metals (e.g., as lead, tungsten), alloys, etc.

The moveable weight member 200 may be removable from the golf club head body 102. Therefore, the moveable weight member 200 could be interchangeable with other moveable weight members that have different weighting characteristics. For example, as a slice or hook is corrected through golf lessons, practice, etc., the different moveable weight members could be replaced to account for the corrected swing. In other words, lighter weights could be used if the slice or hook decreases over time.

According to aspects of this disclosure, the track system 201 may include a track 201*a*. As seen in FIG. 4, the track 201*a* extends around the interior of the wall(s) that comprise the golf club head body 102. According to some aspects of the disclosure the track 201*a* may include a member that protrudes inwardly towards the center of the golf club head from the interior of the wall(s) that comprise the golf club head body 102. In such embodiments, the track 201*a* may be comprised of a lightweight material that causes only a small amount of friction when the moveable weight member 200 slides along the track 201*a*. For example, the track may be plastic, polymer, ceramic, metals, alloys, etc. Alternatively, the track 201*a* may be a groove formed in the interior of the wall(s) that comprise the golf club head body 102.

Figure 7A:
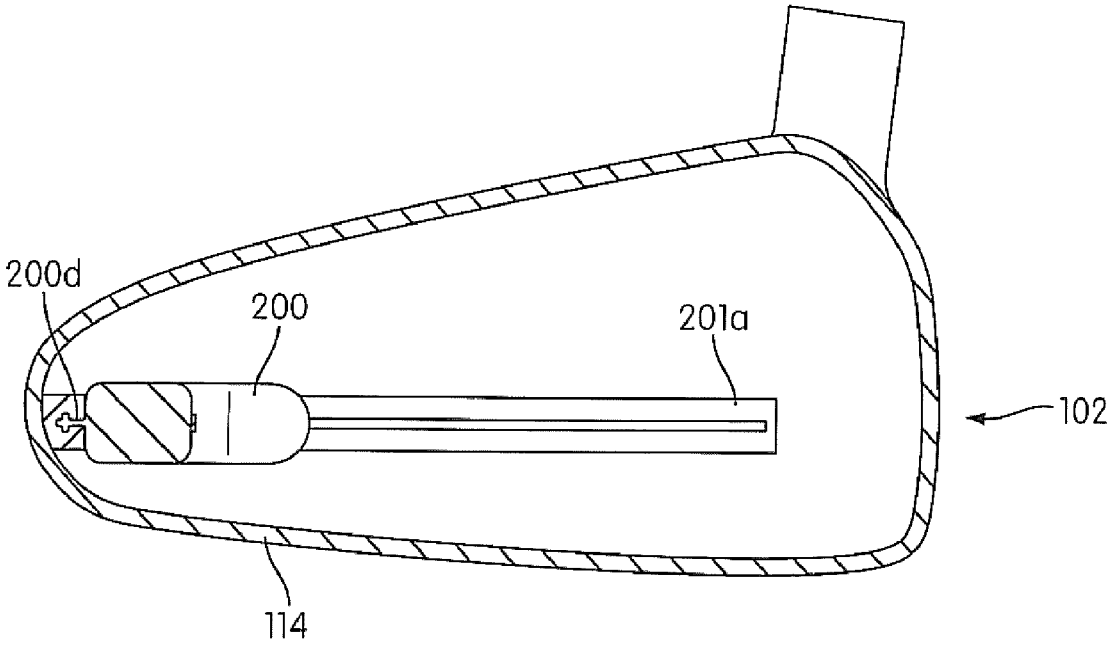
FIGS. 7A-7C are cross sectional views of different golf club head structures according to at least some aspects of this disclosure.
Figure 7B:
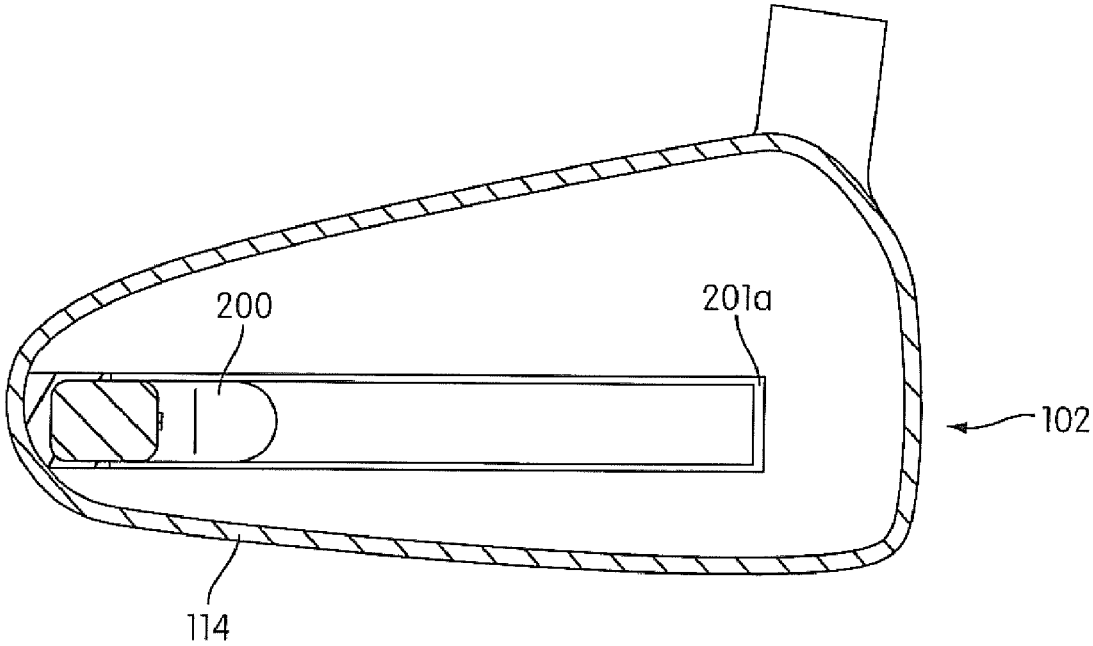

Regardless of how the track 201*a* is formed the track 201*a* may be shaped to correspond to the shape of the moveable weight member 200. For example, FIGS. 7A and 7B show cross-sectional views of different embodiments of the golf club head body 102. As shown in FIG. 7A, the track 201*a* may be shaped to receive and partially surround a rear portion 200*d* of the moveable weight member 200. Alternatively, as shown in FIG. 7B, the track 201*a* may be shaped to receive and partially surround the moveable weight member 200 itself.

According to some aspects of the disclosure, the track 201*a* may have a height between 0.5-6.0 cm, 1.0-4.5 cm, and 2.0-3.0 cm. Further, the moveable weight member 200 may have a length between 1.25-30 cm, 5.0-20.0 cm, and 7.5-15.0 cm, and 10 cm. Further, the track 201*a* may have a depth between 1.0-7.0 cm, 2.0-6.0 cm, and 2.5-5.0 cm.

According to some embodiments, such as those discussed above, the track 201*a* extends around the interior of the golf club head body 102 in a substantially level manner. In other words, portions of the track 201*a* are at the same (or substantially) the same height. However, according to other aspects of the disclosure, the track 201*a* extends around the interior of the golf club head body 102 in a manner wherein portions of the track 201*a* are positioned at relatively different heights.

Figure 7C:
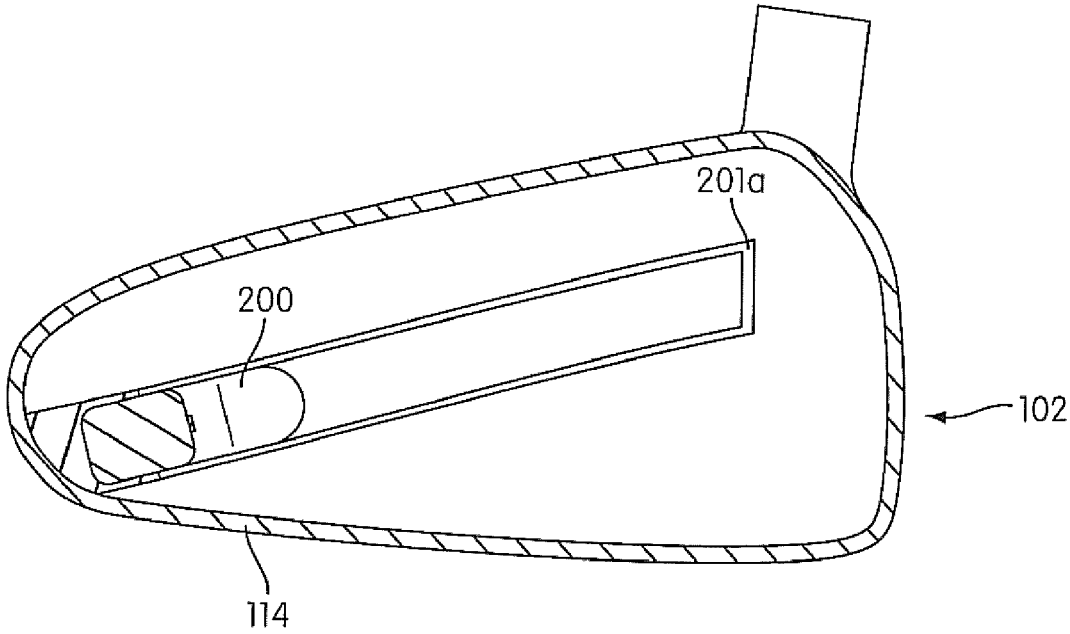

For example, FIG. 7C shows a cross-sectional view of an illustrative embodiment of the golf club head body 102 wherein the portion of the track 201*a* that extends along the rear side of the golf club head body 102 is at a lower height than the portions of the track 201*a* that extend along the heel side and toe side of the golf club head body 102. In other words, the track 201*a* slopes downwardly as it extends from the ball striking face side of the golf club head body 102 to the rear side of the golf club head body 102. Of course this slope does not have to be uniform and instead could have a different steepness at different portions of the golf club head body 102. By forming the track 201*a* in such a manner the moveable weight member 200 may be positioned towards the rear and towards the bottom of the golf club head to distribute more mass of the golf club head towards the rear portion and towards the sole, or bottom of the golf club head which keeps more of the weight of the golf club head body 102 rearward and low. This will aid the golfer in getting the ball airborne upon striking the ball with the club head (i.e., it provides a more lofted trajectory). In some embodiments the track 201*a* may be sloped so that the portion of the track 201*a* that extends along the rear side of the golf club head body 102 is between 1.25 cm and 6.25 cm lower than the portions of the track 201*a* that extends along the heel side and toe side of the golf club head body 102.

The ruling bodies in the game of golf, such as the United States Golf Association (USGA) or The Royal and Ancient Golf Club of St. Andrews (R&A), do not allow portions of the golf club to be adjusted during the round of golf. See e.g., USGA Rules of Golf, Rule 4-2a. Therefore, to ensure the golf club does not violate such rules, the moveable weight member 200 should be held stationary by being locked into a particular position during a round of golf.

Figure 8A:
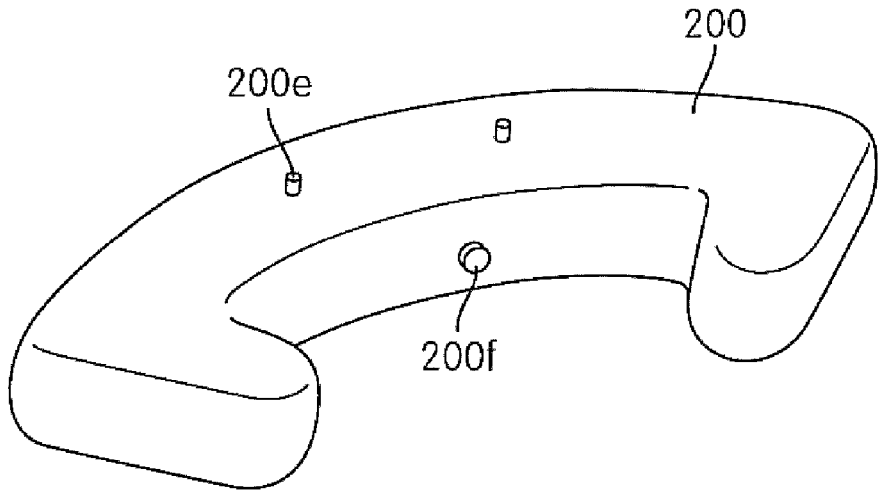
FIGS. 8A-8C are views of a moveable weight member according to at least some aspects of this disclosure.
Figure 8B:
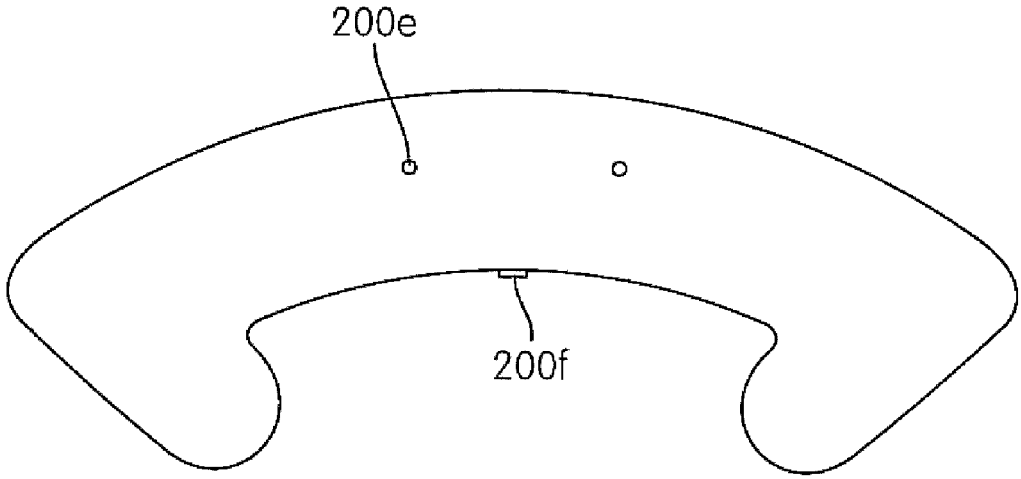
Figure 8C:
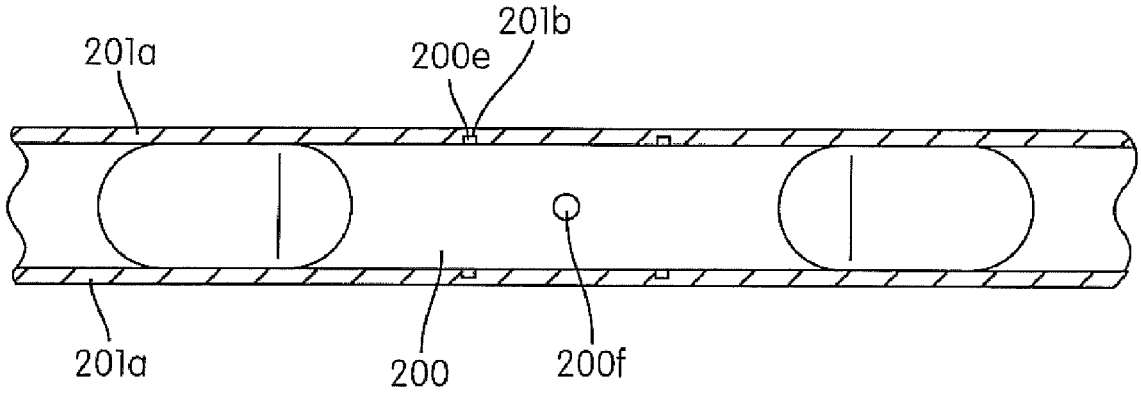
Figure 8D:
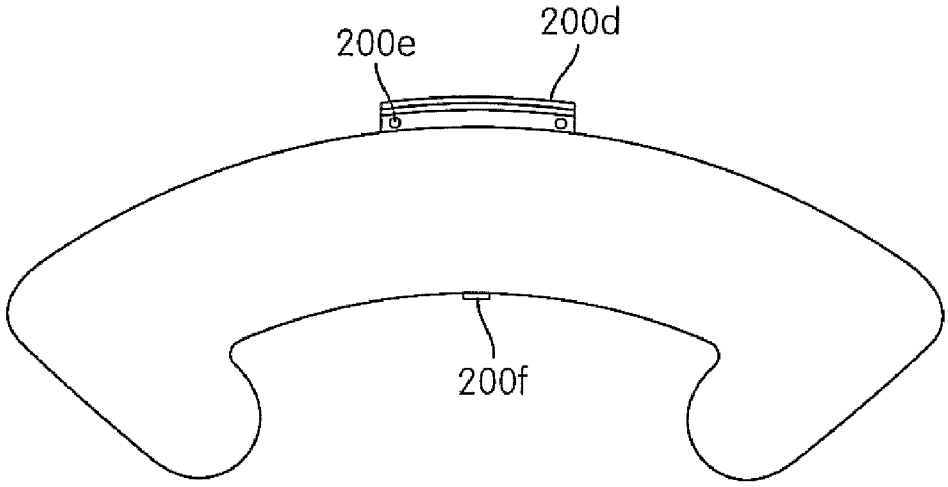
FIG. 8D is an alternate example of a moveable weight member according to at least some aspects of this disclosure.

Hence, according to aspects of this disclosure, the moveable weight member 200 may include a mechanism for locking the moveable weight in a position within the track 201*a* (e.g., one of the positions shown in FIGS. 4B-D). For example, the moveable weight member 200 may have extendable and retractable protrusions. FIGS. 8A-B show an illustrative example of such a moveable weight member 200 wherein the protrusions 200*e* extend from the top and the bottom of moveable weight member 200. The protrusions may be spring loaded and, further, the moveable weight member 200 may include an actuator 200*f* that when depressed retracts the spring loaded protrusions 200*e* and, conversely, when released allows the spring loaded protrusions 200*e* to extend. The track 201*a* of the track system 200 may include recesses or holes 201*b* that receive protrusions 200*e* from the moveable weight member 200 as shown in the embodiment illustrated in FIG. 8C. In this way, when the actuator 200*f* is depressed, the moveable weight member 200 can be slid around the track 201*a* to a particular position. Once the moveable weight member 200 is in the appropriate position, the actuator 200*f* can be released and the spring loaded protrusions 200*e* can extend into the recesses or holes 201*b* in the track 201*a* so that the moveable weight member 200 is locked into place. FIG. 8D shows an alternative embodiment of the moveable weight member 200 wherein the protrusions are in the rear portion 200*d*.

The track system 201 can have a plurality of holes 201*b* positioned throughout the track 201*a*. The holes 201*b* may be positioned throughout the track 201*a* so that the moveable weight member 200 can be locked into place in particular positions such as one of the positions shown in FIGS. 4B-D. Additional holes 201*b* may be positioned throughout the track 201*a* so that the moveable weight member 200 is locked into other of the positions shown in FIGS. 4B-D. Therefore, the moveable weight member 200 can be positioned in a multitude of different positions.

One advantage of the above described embodiment wherein the moveable weight member 200 is slidable within the track system 201, is that the moveable weight member 200 can be quickly, easily and reliably moved from one position to another. Additionally, it is advantageous that above described system allows the moveable weight member 200 to be repositioned without the use of tools. In other words, a golfer can simply move the moveable weight member 200 to the desired position by hand which makes adjustment on the range or before a round a golf a less tedious process.

However, it is noted that even with a plurality of holes provided in the track 201*a*, the positioning of the moveable weight member 200 is still limited by the number of and positioning of the holes 201*b*. Therefore, other methods of securing the moveable weight member 200 into position may be used. For example, threaded fasteners may be used that allow the moveable weight member 200 to be locked into any position on the track 201*a*. Such threaded fasteners may engage with the track 201*a* upon being tightened in order to lock the moveable weight member 200 into place (e.g., a set screw). Further, such threaded fasteners may be loosened to allow the moveable weight member 200 to slide around the track 201*a*.

Of course, other mechanical connectors such as screws, retaining elements, snap fit features, etc. may be used. In some embodiments a tool may be used to attach and/or release the moveable weight member 200 from the track 201*a* of the club head body 102. For example, a screw may be inserted through the moveable weight member 200 and engage a corresponding receiving hole on the track 201*a*. Such a configuration could require a screwdriver to tighten the screw into the hole in the track 201*a* to ensure the moveable weight member 200 is locked into position. It is further noted that while some mechanical connectors have been described above, this is not to imply that mechanical connectors must be used. On the contrary, as long as the moveable weight member 200 and the golf club head 102 can be engaged securely to one another and also easily releasable from one other, such means are considered within the spirit of this disclosure.

As particular aspects of the structure of the moveable weight member 200 and the track system 201 which allows the moveable weight member to slide to different positions within the golf club head body 102 have been described above, now aspects of some of those different positions are discussed below. FIG. 4B shows the moveable weight member 200 in the heel side of the golf club head body 103. This positioning of the moveable weight member 200 causes more mass to be distributed toward the heel side of the golf club head body 103. As described above, such a configuration can help slow the heel during a swing as compared with the toe of the golf club head which will allow a golfer to better square the club head during the swing, which may result in less "slice" (i.e., a straighter trajectory). Therefore, a golfer who has a tendency to "slice" may adjust the moveable weight 200 to such a position in order to compensate for and alleviate the effects of the slice.

For example, in accordance with this disclosure, when the moveable weight member 200 is positioned towards the heel side of the golf club head body 103, the center of gravity of the club head may be shifted towards the heel side of the golf club head body 103 at least 0.5 cm from the geometric centerline running front to back, and in some examples, at least 1.25 cm, at least 2.0 cm, or even at least 2.5 cm. As a result of the shifted center of gravity, this configuration of the golf club head body 102 can provide a draw biased trajectory to a golf ball struck by the golf club head.

FIG. 4D shows the moveable weight member in the toe side of the golf club head body 105. This positioning of the moveable weight member 200 causes more mass to be distributed toward the toe side of the golf club head body 105. As described above, such a configuration can help slow the toe during a swing as compared with the heel of the golf club head 102 which will allow a golfer to better square the golf club head during the swing, which may result in less of a "hook" (i.e., a straighter trajectory). Therefore, a golfer who has a tendency to "hook" may adjust the moveable weight 200 to such a position in order to compensate for and alleviate the effects of the hook.

For example, in accordance with this disclosure, when the moveable weight member 200 is positioned towards the toe side of the golf club head body 105, the center of gravity of the club head 102 may be shifted towards the toe side of the golf club head body 105 at least 0.5 cm from the geometric centerline running front to back, and in some examples, at least 1.25 cm, at least 2.0 cm, or even at least 2.5 cm. As a result of the shifted center of gravity, this configuration of the golf club head body 102 can provide a fade biased trajectory to a golf ball when it is struck by the golf club head.

FIG. 4C shows the moveable weight member in the rear side of the golf club head body 102. Further, according to aspects of this disclosure, such as shown in FIG. 8C, when the moveable weight member is positioned in the rear side of the golf club head 109 it may also be positioned near the sole 114 of the golf club head. This positioning of the moveable weight member 200 causes more mass to be distributed toward the rear side of the golf club head body 109 and also towards the bottom of the golf club head body which keeps more of the weight of the golf club head body rearward and low. As described above, such a configuration can help a golfer obtain a higher trajectory or get the ball airborne. Therefore, a golfer who has a tendency to "duff" (i.e., hit the ball so that it skims along the ground rather than travel with an elevated loft through the air) may adjust the moveable weight 200 to such a position in order to compensate for the not getting the ball airborne and alleviate the effects of the "duff."

For example, in accordance with this disclosure, when the moveable weight is positioned towards the rear side of the golf club head body 109 and towards the sole of the golf club head body 102, the center of gravity of the club head may be shifted towards the rear side of the golf club head body at least 0.5 cm from the geometric centerline running toe to heel, and in some examples, at least 1.25 cm, at least 2.0 cm, or even at least 2.5 cm. Further, the center of gravity of the club head body 102 may be shifted towards the sole of the golf club head body at least 0.5 cm and, in some examples, at least 1.25 cm, at least 2.0 cm, or even at least 2.5 cm. As a result of the shifted center of gravity, this configuration of the golf club head body 102 can provide a higher trajectory to a golf ball struck by the golf club head.

Some embodiments of the disclosure include a track 201*a* which extends around the interior of the golf club head body 102 in a substantially level manner (i.e., the portions of the track 201*a* are at the same (or substantially the same) height). Therefore, the moveable weight member 200 may be positioned at the rear side of the golf club head body 109 without being moved closer to the sole 114 of the golf club head body 102.

Of course, as described above, the moveable weight member 200 may be positioned in a location other than the positions shown in 4B-D. For example, a golfer with a slight slice may only need the moveable weight member positioned midway between the rear side position shown in FIG. 4C and the heel side position shown in FIG. 4B. Conversely, a golfer with a slight hook may only need the moveable weight member positioned midway between the rear side position shown in FIG. 4C and the heel side position shown in FIG. 4D. Therefore, it is understood that the moveable weight member 200 can be used to fine tune the mass and weighting characteristics of the golf club head body 102 based on the particular tendencies of the golfer.

Figure 9A:
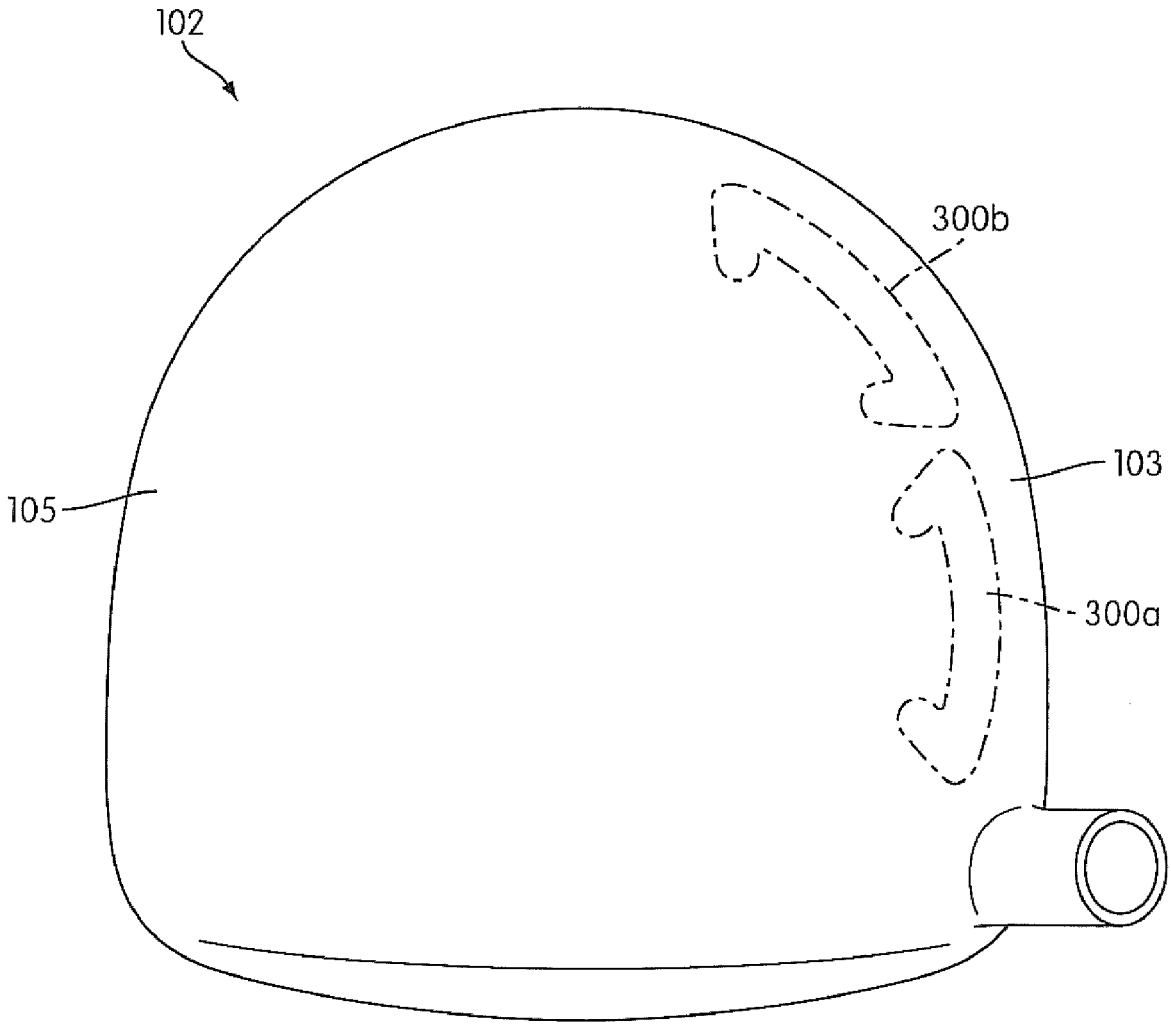
FIGS. 9A-9C are views of an illustrative embodiment of an alternative golf club head according to at least some aspects of this disclosure.

According to some aspects of the disclosure, multiple moveable weights may be used instead of a single moveable weight member. FIG. 9A shows a top view of such an embodiment. As seen in FIG. 9A, multiple moveable weights 300*a* and 300*b* (shown in phantom line) may be used in the same manner as the moveable weight member 200 described above. In other words, the multiple moveable weights 300*a* and 300*b* can be moved around the interior of the golf club head 102 via the track system 201 that extends around the interior of the wall(s) that comprise the golf club head body 102.

Figure 9B:
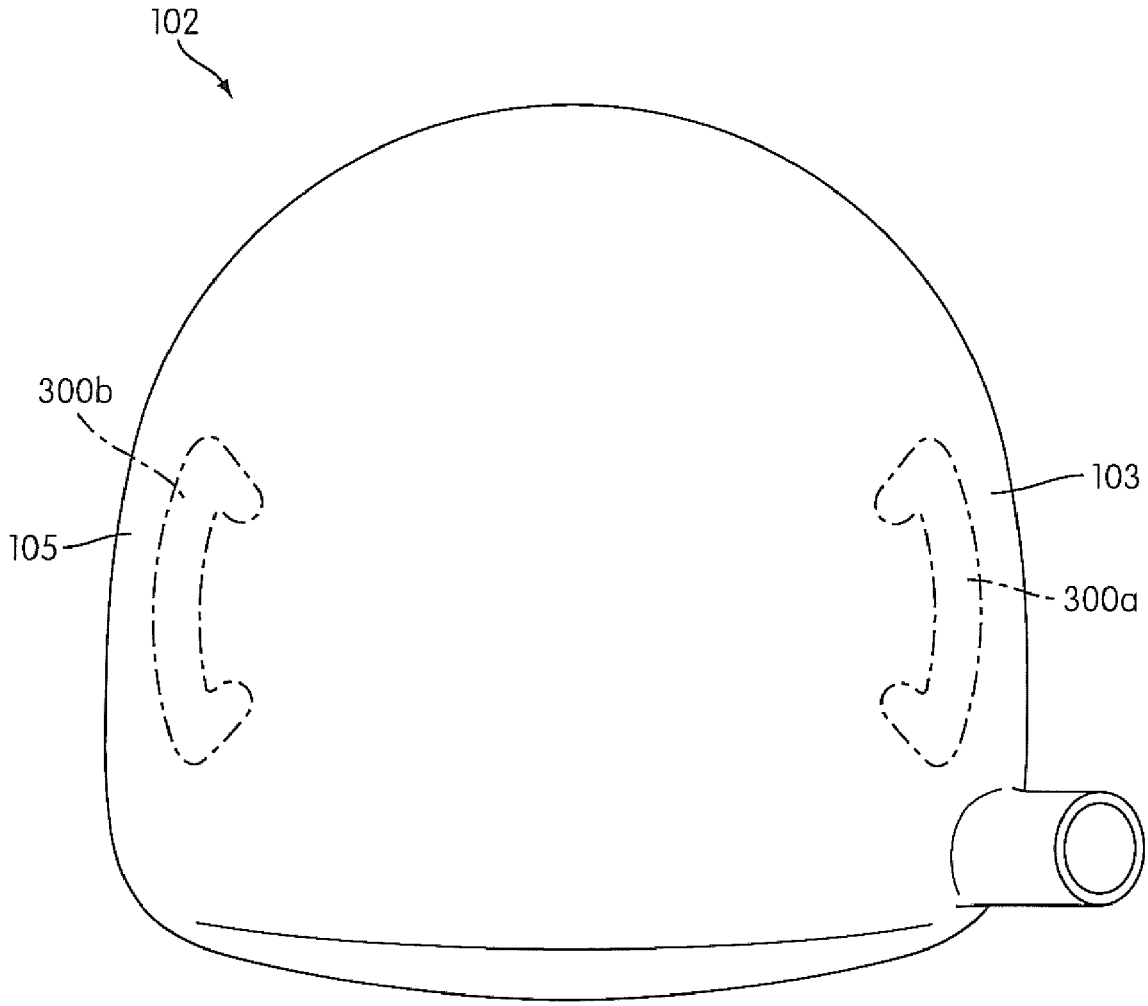

As seen in FIG. 9A, the multiple moveable weights 300*a* and 300*b* may be positioned together on a side of the golf club head body 102 (e.g., the heel side, the toe side, the rear side, etc.). Alternatively, the multiple moveable weights 300 may be positioned at different sides of the golf club head body 102. For example, as seen in FIG. 9B, the moveable weight 300*a* may be positioned in the heel side 103, while moveable weight 300*b* may be positioned in the toe side 105. It is noted that while the above figures represent two possible positionings of the multiple moveable weights 300*a* and 300*b* along the track 201*a*, of course, the multiple moveable weights 300*a* and 300*b* could be moved to other positions as well. Also, according to other aspects of this disclosure, the golf club head body 102 may include more than two multiple weights. For example, three or more multiple moveable weights 300 may be used. Having multiple moveable weights that are moveable independently of each other allows the mass and weighting characteristics of the golf club head body 102 to be fine tuned based on the particular tendencies of the golfer.

Figure 9C:
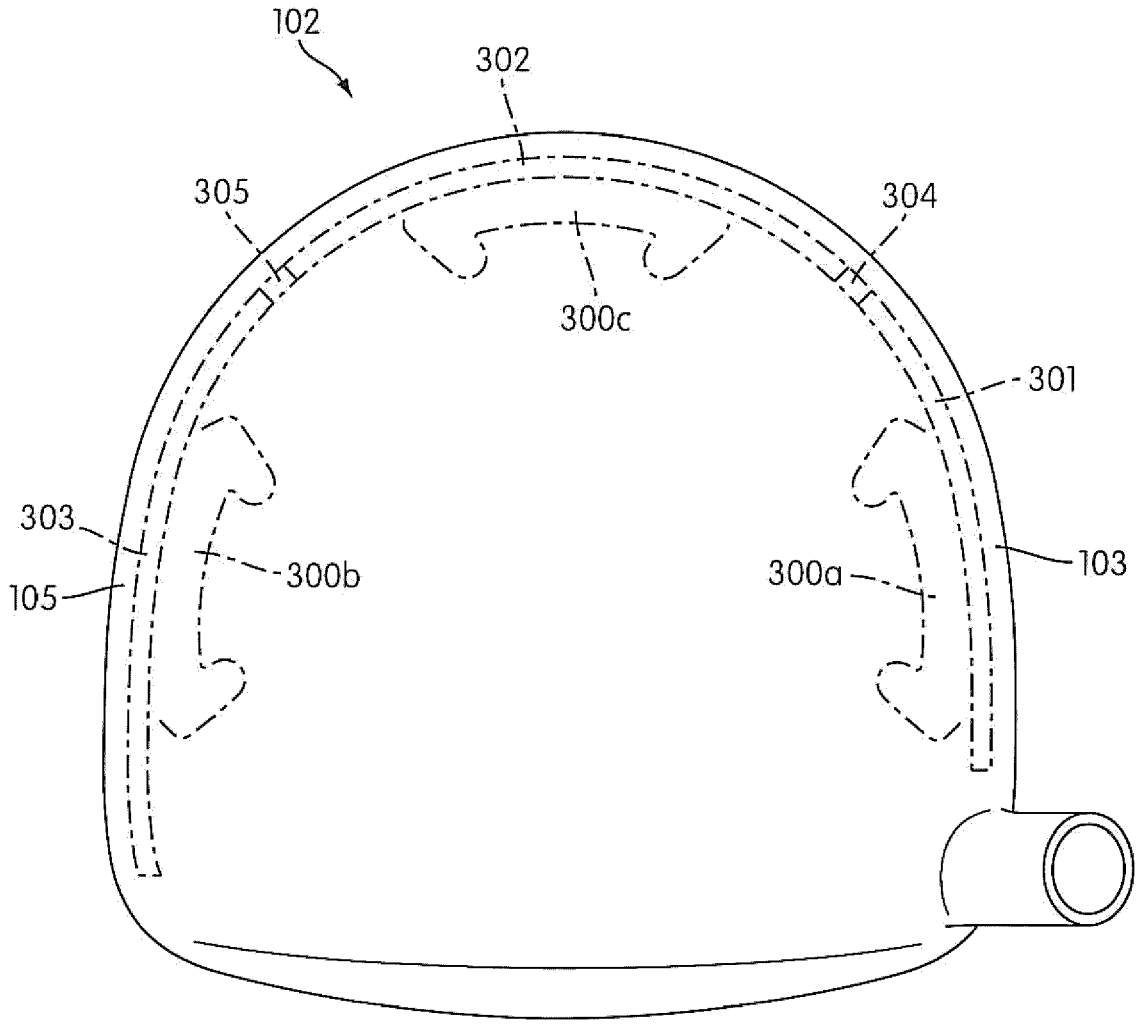

The multiple moveable weights 300 may be similar to the moveable weight member 200 described above. For example, the multiple moveable weights 300 may be shaped so as to correspond to the shape of the wall(s) that comprise the golf club head body 102 (e.g., multiple moveable weights may be curved or exhibit a "U" or "C" shape); include a rear portion which extends along rear of the multiple moveable weight and can engage with the track system; have a large specific gravity, density and weight; etc. Therefore, for the sake of brevity, further specific characteristics of the multiple moveable weights will not be described here in detail According to some aspects of this disclosure, the track 201*a* may include partitions between different sections of the track 201*a* which are designed to limit the movement of the moveable weights 300 to particular ranges. For example, FIG. 9C shows such an embodiment wherein the track 201*a* is partitioned into three sections (a section 301 in the heel side 103, a section 303 in the toe side 105 and a section 302 in the rear side 109) by two partitions, or walls, 304 and 305. Further, each of the three sections 301-303 may include a single moveable weight 300*a-c*. Each of the moveable weights 300*a-c* will be moveable within its respective section.

Figure 10:
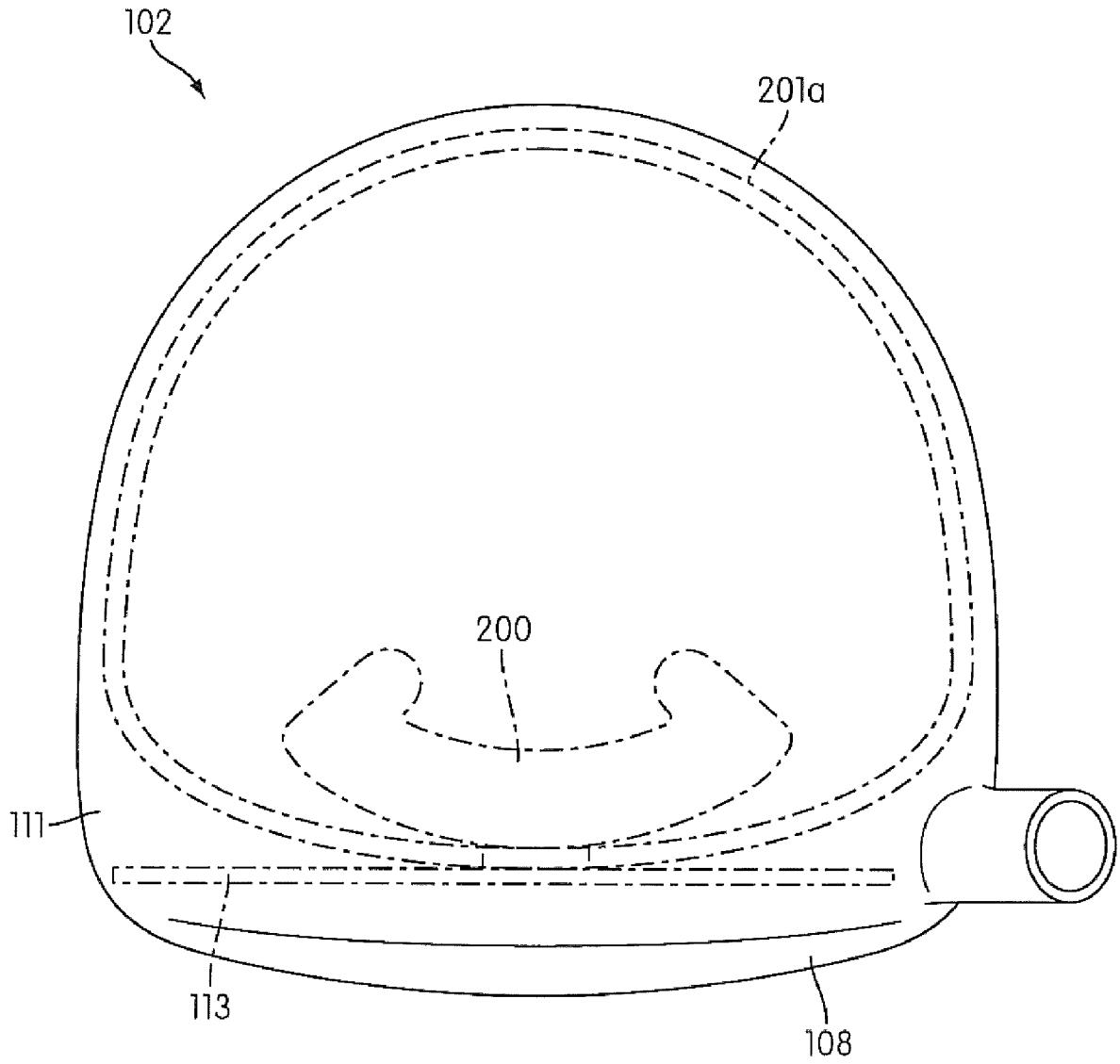
FIG. 10 generally illustrates another example golf club head structure in accordance with this disclosure.

According to some aspects of the disclosure, the track 201*a* may extend 360° around the interior of the golf club head body 102. In such embodiments, the moveable weight member 200 can be positioned near the ball striking face portion 108 of the golf club head body 102. FIG. 10 shows a top view of such an embodiment. As seen in FIG. 10, such an embodiment can include an interior wall portion 113 (shown in phantom line) near the ball striking face portion 108 along which the track 201*a* is positioned. In such embodiments, the track 201*a* (shown in phantom line) may have a length between 30-60 cm. FIG. 10 shows the moveable weight member 200 in the ball striking face side 111 of the golf club head body 102. Further, according to aspects of this disclosure, when the moveable weight member 200 is positioned in the ball striking face side 111 of the golf club head it may also be positioned near the crown 112 of the golf club head. For example, a track with a slope similar to the track shown in FIG. 7C may be used. This positioning of the moveable weight member 200 causes more mass to be distributed toward the ball striking face side 111 of the golf club head body 102 and also towards the top of the golf club head body 102 which keeps more of the weight of the golf club head body forward and high. Such a configuration can help a golfer create a more boring trajectory as opposed to a lofted trajectory. Therefore, such a configuration can provide a shot that will "run" or roll. A golfer who has a tendency to "pop up" shots may adjust the moveable weight 200 to such a position in order to compensate for and alleviate the effects of the "pop up." Further such a configuration may be advantageous in windy conditions when a lofted shot is less desirable.

For example, in accordance with this disclosure, when the moveable weight is positioned towards the ball striking face side 111 of the golf club head body 102, and towards the crown 112 of the golf club head body, the center of gravity of the club head may be shifted towards the ball striking face side 111 of the golf club head body 102 at least 0.5 cm from the geometric centerline running toe to heel, and in some examples, at least 1.25 cm, at least 2.0 cm, or even at least 2.5 cm. Further, the center of gravity of the club head body 102 may be shifted towards the crown 112 of the golf club head body at least 0.5 cm and, in some examples, at least 1.25 cm, at least 2.0 cm, or even at least 2.5 cm. As a result of the shifted center of gravity, this configuration of the golf club head body can provide a more boring trajectory to a golf ball when it is struck by the golf club head.

It is not necessary for the portion of the track 201*a* near the ball striking face portion 108 to be positioned near the crown 112. Instead, according to some embodiments of this disclosure, the track 201*a* which extends around the interior of the golf club head body 102 in a substantially level manner (i.e., the portions of the track 201*a* are at the same (or substantially the same) height). Therefore, the moveable weight member 200 may be positioned at the ball striking face side 111 of the golf club head body 102 without being moved closer to the crown 112 of the golf club head body 102.

According to other aspects of this disclosure, the golf club head body may include a loop that extends from a heel side 103 of the golf club head body around a rear side 109 of the golf club head body to a toe side 105 of the golf club head body. According to some aspects of the disclosure, one or more moveable weights may move around the golf club head body via the loop.

Figure 11A:
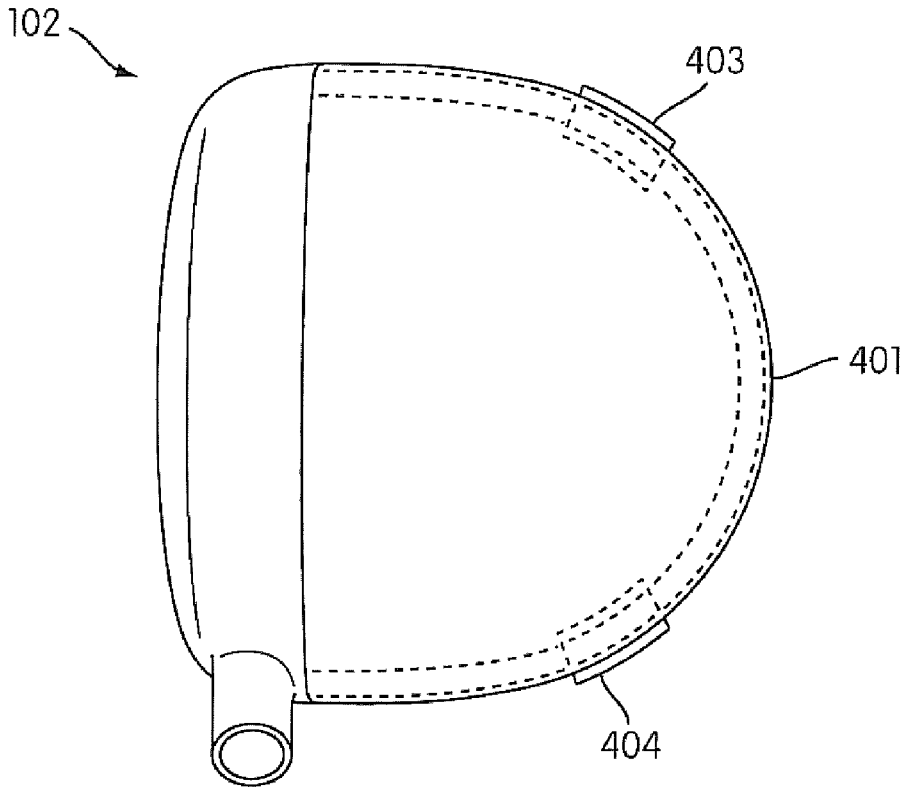
FIGS. 11A-11B generally illustrate another example golf club head structure in accordance with this disclosure.

FIG. 11A shows a top view of an illustrative embodiment of the golf club head body 102. As seen in FIG. 11A, the golf club head body 102 may include a loop 401 (shown in phantom line) which extends from a heel side of the golf club head body around a rear side of the golf club head body to a toe side of the golf club head body. Further, one or more moveable weights may slide along the loop 401. For example, as seen in FIG. 11A, moveable weights 403 and 404 have a hole through their center through which the loop 401 extends. In this way, the moveable weights 403 and 404 can slide from a position in the heel side to a position in the rear side to a position in the toe side of the golf club head body 102. The moveable weights 400 could be moved to other positions as well (e.g., to positions between the above described positions). It is noted that much of the structure of this embodiment is similar to the embodiments described above and, therefore, specific discussion may be omitted for the sake of brevity.

According to aspects of this disclosure, the moveable weight members 403, 404 may include a mechanism for locking in a position on the loop 401. For example, the moveable weights 403, 404 may have set screws or other mechanical connectors, such as described above in regard to previous embodiments.

Figure 11B:
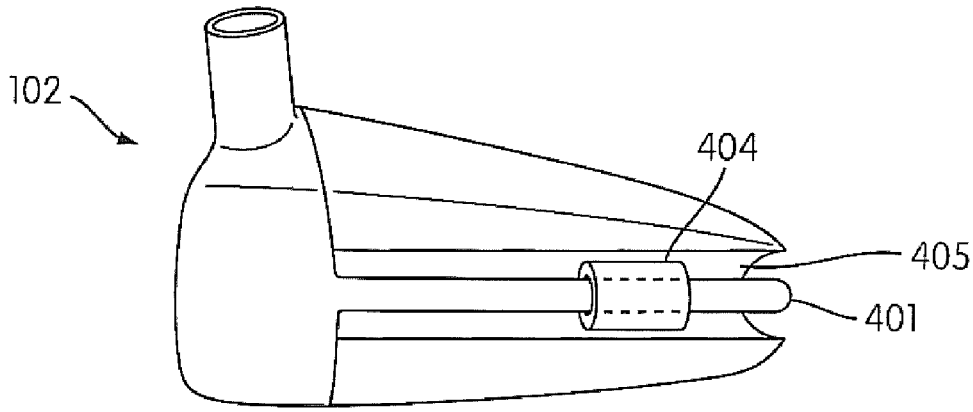

According to some aspects of the disclosure, loop 401 may be housed in a groove 405 in the golf club head body 102. For example, FIG. 11B shows a perspective view of golf club head body 102 wherein the loop 401 is housed in the groove 405. According to some aspects of the disclosure, the groove 405 may have a height between 0.5-6.0 cm, 1.0-4.5 cm, and 2.0-3.0 cm. Further, the groove 405 may have a length between 1.25-30 cm, 5.0-20.0 cm, and 7.5-15.0 cm, and 10 cm. Further, the groove 405 may have a depth between 1.0-7.0 cm, 2.0-6.0 cm, and 2.5-5.0 cm. The moveable weight members 403, 404 may have a height between 0.5-5.5 cm, 1.0-4.0 cm, and 2.0-2.5 cm. Further, the moveable weight members 403, 404 may have a length between 1.25-15 cm, 5.0-13.0 cm, and 7.5-10.0 cm. Further, the moveable weight members 403, 404 may have a depth between 1.25-6.5 cm, 2.0-5.0 cm, and 2.5-4.0 cm. Further, the moveable weight members 403, 404 may have a mass between 5.0-70 grams, 20-60 grams, 30-55 grams, or 50 grams. The loop 401 may have a diameter of between 0.1-1.0 cm.

According to some embodiments, such as those discussed above, the loop 401 extends around golf club head body 102 in a substantially level manner. However, according to other aspects of the disclosure, the loop 401 may extend around the golf club head body 102 in a manner wherein portions of the track 201*a* are positioned at relatively different heights. Since much of this structure is similar to the embodiments described above, further specific discussion is omitted for the sake of brevity.

According to particular aspects of the invention the loop 401 may be formed integrally with the golf club head or may be removeably attached (e.g., via threaded fasteners). Further, it is noted that while the loop 401 is shown as being exposed in the depicted embodiment, according to some aspects of the disclosure, the loop be contained internally within the golf club head body 102 so that it is not exposed. According to such embodiments, the loop 401 and the moveable weight members 403 and 404 may be contained within the golf club head body such that neither the loop 401 nor the moveable weight members 403 or 404 are exposed (similar to the above described embodiments).

According to some aspects of the disclosure, the loop 401 may extend 360° around the interior of the golf club head body 102. In such embodiments, the moveable weight members 403, 404 can be positioned near the ball striking face portion of the golf club head body 102. In such embodiments, the loop 401 may have a length between 30-60 cm. Since much of this structure is similar to the embodiments described above, further specific discussion is omitted for the sake of brevity.

Particular aspects that the structure of the moveable weight members 403, 404 and the loop 401 have upon the mass and weight characteristics of the golf club head body are similar to the embodiments described above, and, therefore, further specific discussion is omitted for the sake of brevity.

Golf professionals are known to work with golfers to assist them in improving their golf game including their swing and associated play by analyzing the golfer's tendencies, providing instruction and recommendation regarding modifications to their swing and also in recommending various equipment including selection of clubs. Further, a golf professional for a certain golf manufacturer may offer a selection of features for which the golfer may select either alone, or with the assistance of the golf professional. Among the features that vary from golf club to golf club are various weighting characteristics of the golf club head. Each golfer may have a swing tendency that varies from other golfers. Accordingly golfers may desire and benefit from an individualized fitting of a golf club such that the golfer's swing characteristics and swing tendencies may be noted and accounted for. In a fitting process, a golfer may have his or her swing analyzed by a professional either visually or by using any of various measuring and analysis devices known in the art.

Figure 12A:
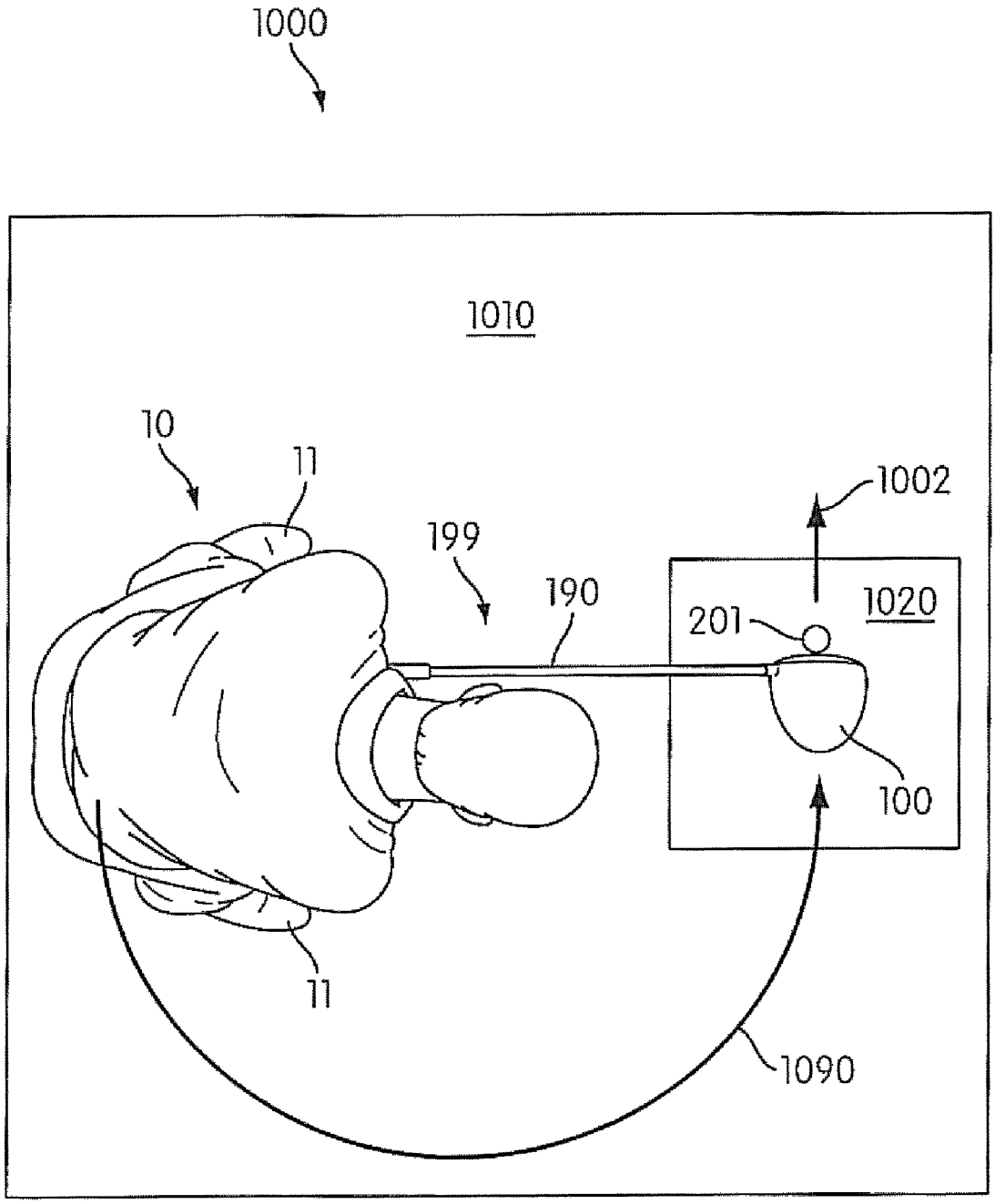
FIGS. 12A-12C illustratively depict aspects of a method of fitting a golf club and associated devices.
Figure 12B:
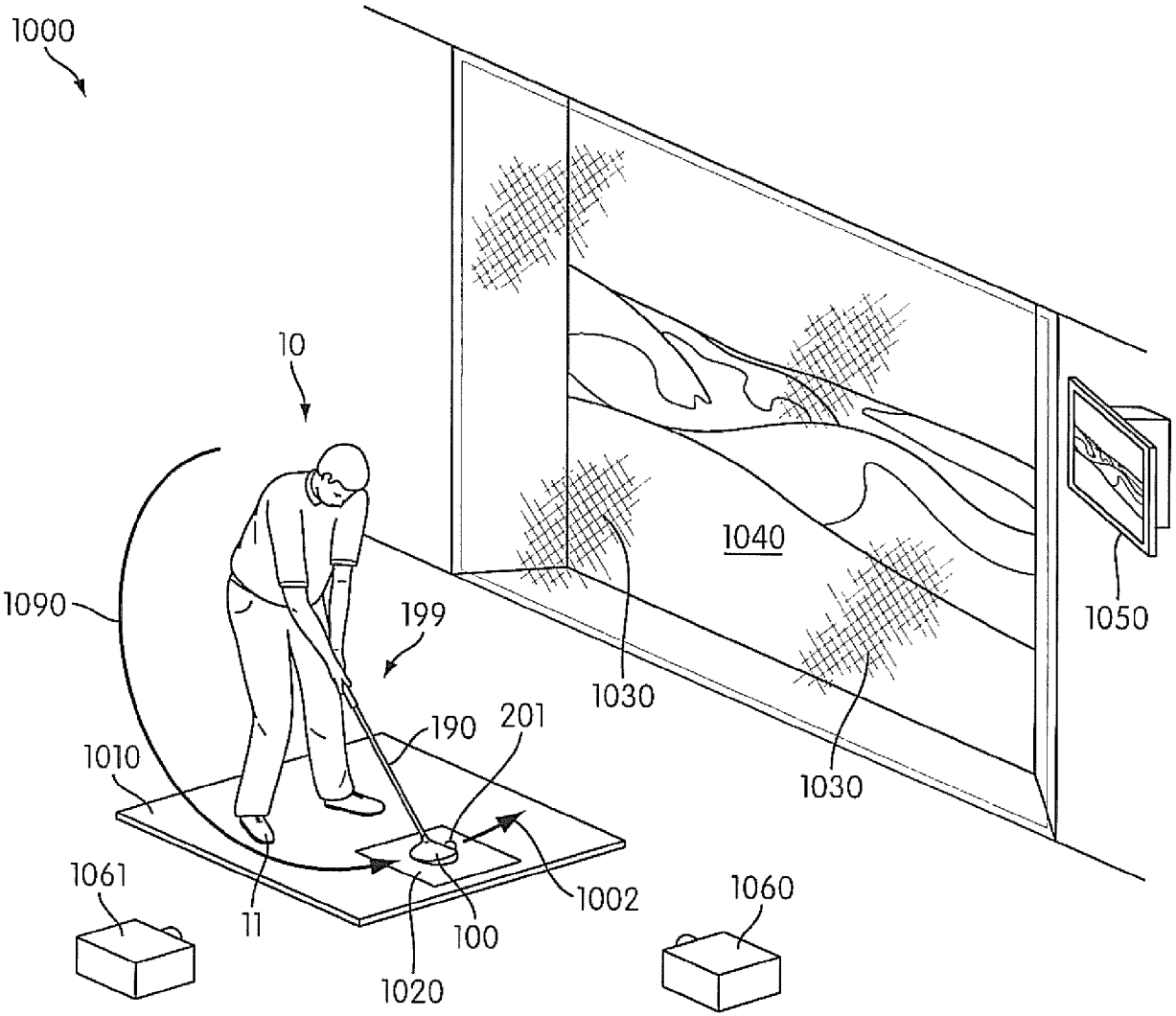
Figure 12C:
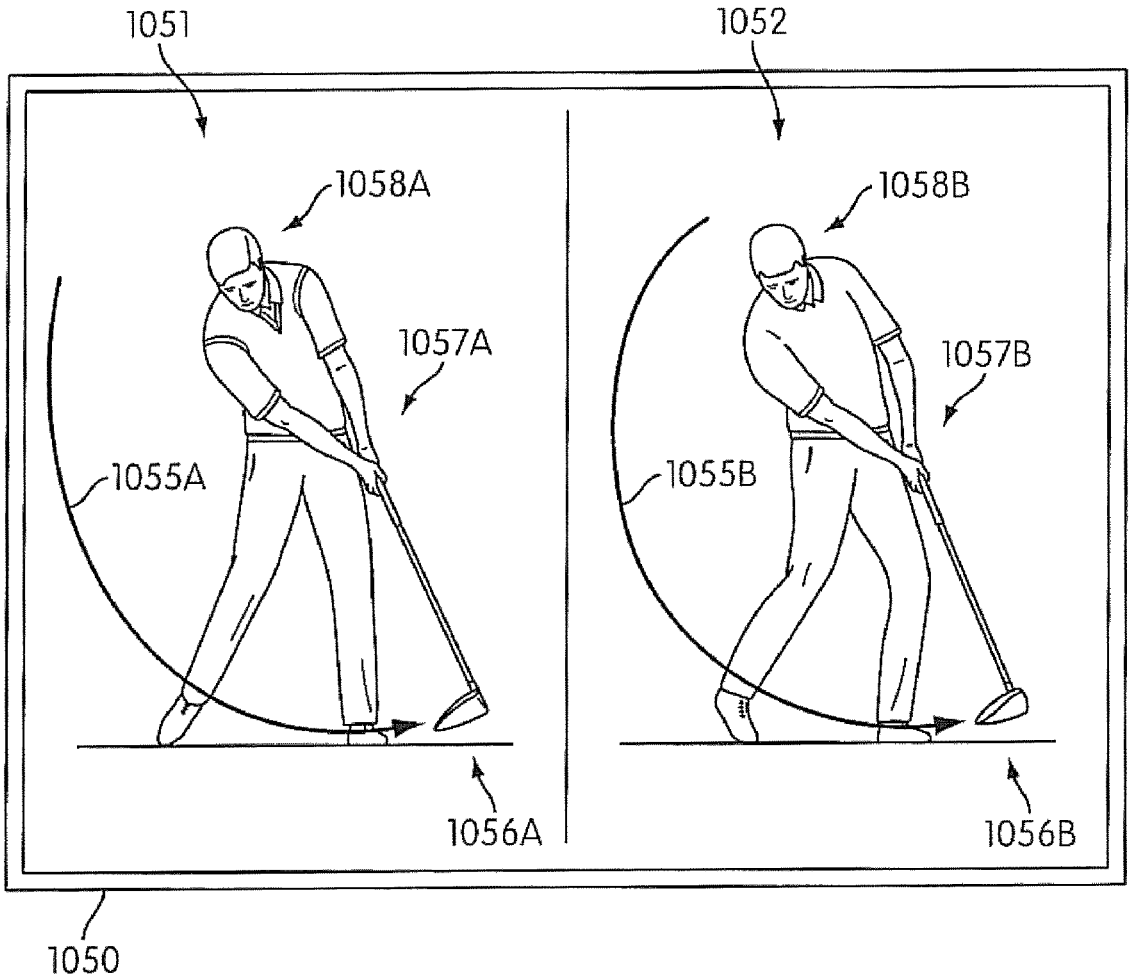

FIGS. 12A-12C illustratively depict one manner of fitting a golf club 100 including the weighting characteristics of the golf club head 102. As is known, a golfer 10 may perform a number of swings in front of one or more golf professionals or golf club fitters. The movements including the golf swing may be viewed, recorded, and/or measured by a measuring device including a videographic device like a digital video camera. FIGS. 12A and 12B illustrate top plan and rear views respectively of a golfer swinging a golf club and hitting golf balls in an illustrative fitting station 1000. The fitting station 1000 may have any of a number of arrangements and features. The fitting station 1000 shown in FIGS. 12A-12C is an indoor fitting station. However, fitting station 1000 may be indoor or outdoor and may be located at a driving range or other practice facilities, at a golf course including in or near a pro shop and various other locations as are known. The fitting station 1000 may include a hitting mat 1010, especially when the fitting station is an indoor station or when the station is part of a driving range. Although, a fitting station may occur on a grass tee box or other outdoor natural golf environment. Here, the indoor fitting station 1000 also includes a net 1030 that a golfer 10 may hit the ball into in performing his or her shots, practice swings and swings in front of a golf professional or golf club fitter. The net 1030 permits the fitting to be done in a more limited space such as indoors, in a pro shop or in a driving range with limited land available. Behind the net 1030 may be a background 1040 or other structures that may make the golfer feel as if he is on the golf course. Also, while not specifically depicted, the background may house or protect a further measuring device(s) including velocity or force sensors, videographic devices and other devices that may be utilized in the fitting of the golfer.

The ball travel of a golfer's shot may be monitored by watching an entire ball flight at a fitting station on a driving range that possesses sufficient space for the ball to travel until it comes to a natural stopping point/lie. Also, a golfer may also hit in a confined spaced monitored by a digital video camera or other computing devices that can determine the travel path based upon initial characteristics of the shot including velocity, trajectory, spin etc. Further measuring devices may be used to further understand the swing path and related tendencies of a golfer. In one example configuration, a golfer's swing may be filmed using a digital video camera device 1060. In particular the golfer's swing may be filmed from a toe end view such that the golfer has a stance square to and facing the camera. In another configuration, the golfer's swing may alternatively or additionally be filmed by a measuring device positioned at a position such as the position where measuring device 1061 is illustratively shown. By filming the golfer's swing from square orientations such as the rear and toe end, the video may be compared to images and swing paths performed and recorded by a golfer having preferred mechanics as shown in FIG. 12C.

Among the devices and tests that may be used to monitor the swing path, contact orientation and related characteristics of a golfer swing are video recording, radar tracking including Doppler radar technology, motion detection devices, speed radar devices, ball flight tracking devices and monitoring systems and similar golf swing analysis devices as are known in the art. These measuring devices may be positioned as illustrative measuring devices 1060, 1061 are shown as being positioned. These devices may also be positioned in front of the golfer 10 such that the golfer is hitting at the measuring device or on the heel end side of the golfer behind the golfer's back. Even further, measuring devices may be placed overhead or practically anywhere such that the measuring devices can record data such as video images of the golfer's movements or track and record data or characteristics associated with the portions of the golf club or ball movement such as velocity, direction, orientation, and other characteristics as are known. Other devices focused at determining the golf club's orientation during the swing and in particular the orientation of the golf club through the hitting zone when the golf club head strikes the golf ball may be utilized. These devices may be the same or similar devices as the videographic, radar or other motion tracking devices or the devices may be as simple as lie board devices which depict where a bottom surface of the golf club contacts the ground and the direction of movement and orientation of the club through the hitting zone. Also basic tape devices placed over the hitting surface 1020 of a golf club head may be used to provide data regarding the portion of the hitting surface 1020 where the golf ball is being hit to determine whether the ball is being hit in a desired spot on the club face (e.g., center) or off-center such that the swing or club may need adjustment to optimize results.

After a sufficient number of swings and "practice" or "sample" shots have been made to provide a desired sampling of shots to provide for a reliable fitting, the golf and/or fitting professionals can use the data collected to recommend particular mass and weighting characteristics for a golf club head 102 (including the positioning of the one or more moveable weight members with the golf club head body) that will help the golfer hit a golf ball in an intended and desired direction and/or with an intended and desired flight path. Among the characteristics collected or measured may include swing path data, trajectory, orientation of the golf club on impact, ball spin, ball flight and physical dimensions and ergonomic characteristics of the golfer, to name just a few. The analysis of the swings including swing patterns can be used to determine a desired swing path, tendencies of the golfer's swing, and changes to the golfer's current swing path such that the specific changes required may be more visibly noticeable. The mass and weighting characteristics may be determined and shown such that an analysis (e.g., computer analysis) can be performed to determine whether a positioning of the one or more moveable weight members within club head is appropriate as maximizing the performance of a golfer with particular swing tendencies.

FIG. 12C illustrates a display 1050 depicting two respective swing characteristics outputs 1051, 1052 illustratively depicting two swings of golfers in videographic form such as digital video. In one arrangement the displayed swing 1051 may be a videographic image of preferred swing of a professional golfer or other golfer including a "virtual golfer" with preferred swing mechanics. On the right, the golf swing 1052 may be an actual swing of a golfer 10 currently being analyzed in the fitting station 1000. Through the split screen comparison on display 1050, a golfer may be analyzed and fitted for a particular golf club features such as visual swing indicators, shaft characteristics, and alignment aides and other features to facilitate a golfer swinging in a preferred manner to achieve preferred performance. For example, backswing paths 1055A, 1055B of the golfers may be compared during the swings 1051, 1052. Likewise, the orientations of the golf club head 1056A, 1056B, the golfers' arm and hand positions 1057A, 1057B, and the head positions 1058A, 1058B may be compared visual. Other comparisons and analysis may be performed as is known. While the display 1050 here illustrates videographic information relating to the golfers' swings, the display 1050 may be utilized during other aspects of the analysis including output of various other characteristics utilized in fitting the golfer 10. Further, as shown in FIG. 13B the display 1050 may also be used to enhance the fitting experience and may be visible to the golfer during the fitting process. However, various configurations of outputs can be used to perform a swing analysis and provide output data relating to the golfer's swing to the golfer or the golf professional.

Therefore, using the above described fitting processes, the positioning of the one or more moveable weight members can be particularly utilized to adjust and control mass and weighting characteristics of the golf club head body 102 to customize the golf club head body 102 to fit particular swing types or a golfer's tendencies. For example, the above described fitting processes could be used in conjunction with a method for positioning the moveable weight member within a golf club head body in order to provide an intended and desired trajectory for the golf ball. The method includes determining a characteristic of a golfer's swing based upon a swing of the golf club using a measuring device. The method further includes determining a desired ball trajectory. The method further includes selecting a particular position within the golf club head body for a moveable weight member contained internally within the golf club head body based upon the determined swing characteristic and the desired ball trajectory. The method further includes positioning the moveable weight member internally within the golf club head body at a position that will provide the desired ball trajectory.

III. CONCLUSION

Aspects of the present invention are described above and in the accompanying drawings with reference to a variety of example structures, features, elements, and combinations of structures, features, and elements. The purpose served by the disclosure, however, is to provide examples of the various features and concepts related to the invention, not to limit the scope of the invention. One skilled in the relevant art will recognize that numerous variations and modifications may be made to the embodiments described above without departing from the scope of the present invention, as defined by the appended claims.

For example, the dimensions and/or other characteristics of a golf club head structure according to examples of this disclosure may vary significantly without departing from the disclosure. For example, any wood type club head may be provided including, for example: wood type hybrid clubs, fairway woods, drivers, etc.

Additionally, the various features and concepts described above in conjunction with FIGS. 1 through 12 may be used individually and/or in any combination or subcombination without departing from this disclosure.

We claim:

1. A golf club head comprising:

a wood type golf club head body;

a moveable weight member contained internally within the golf club head body so that the moveable weight member is not exposed; and a track system contained internally within the golf club head body so that the track system is not exposed, wherein the track system includes a track which extends around the interior of one or more walls that comprise the golf club head body, wherein the moveable weight member is configured to be moved around the interior of the golf club head by sliding in the track, wherein the track extends from a heel side of the golf club head body along a rear side of the golf club head body to a toe side of the golf club head body, wherein the track is positioned on or in the interior wall or walls that comprise the heel, toe and rear sides of the golf club head body, wherein the moveable weight member is moveable from a position in the heel side to a position in the rear side to a position in the toe side of the golf club head body, wherein the track does not extend along a sole of the golf club head body but along the side of a head between a crown and the sole, wherein adjusting the moveable weight member is done from within a main hollow cavity of the head body during which the moveable weight member is not exposed outside from the side head body between the crown and the sole.

2. The golf club head according to claim 1, wherein the track slopes downwardly from a ball striking face side of the golf club head body to the rear side of the golf club head body, wherein a portion of the track that extends along the rear side of the golf club head body is at a height lower than portions of the track that extend along the heel side and toe side of the golf club head body.

3. The golf club head according to claim 1, wherein the moveable weight member includes a locking mechanism which allows the moveable weight member to be locked in a particular position along the track.

4. The golf club head according to claim 3, wherein the locking mechanism includes at least one extendable and retractable protrusion, wherein the protrusion is configured to be extended and engage at least one hole in the track.

5. The golf club head according to claim 4, wherein the locking mechanism includes an actuator configured to retract the at least one protrusion when the actuator is depressed and wherein the actuator is configured to allow the at least one protrusion to extend when the actuator is released.

6. The golf club head according to claim 3, wherein the locking mechanism includes a threaded fastener configured to engage at least one hole in the track.

7. The golf club head according to claim 1, wherein the track extends 360 degrees around the interior of the golf club head body, from the heel side of the golf club head body along the rear side of the golf club head body and the toe side of the golf club head body to a ball striking face side of the golf club head body, wherein the track is positioned on or in the interior wall or walls that comprise the heel, toe, rear and ball striking face sides of the golf club head body.

8. The golf club head according to claim 7, wherein the track slopes downwardly from a ball striking face side of the golf club head body to the rear side of the golf club head body, wherein a portion of the track that extends along the rear side of the golf club head body is at a height lower than portions of the track that extend along the heel side and toe side of the golf club head body, wherein a portion of the track that extends along the ball striking face side of the golf club head body is at a height higher than portions of the track that extend along the heel side and toe side of the golf club head body.

9. The golf club head according to claim 1, wherein the moveable weight member has a height between 0.5-5.5 cm, a length between 1.25-15 cm, a depth between 1.25-6.5 cm and a mass between 5.0-70 grams.

10. The golf club head according to claim 1, wherein the track has a height between 0.5-6.0 cm, a length between 1.25-30 cm and a depth between 1.0-7.0 cm.

11. The golf club head according to claim 1, wherein the moveable weight member is shaped to correspond to the shape of the walls that comprise the golf club head body and exhibits at least of a U-shape or C-shape which faces a center of the golf club head body.

12. The golf club head according to claim 1, wherein the moveable weight member does not directly contact with an exterior wall of the golf club head.

13. A golf club comprising:

a shaft;

a grip;

a wood type golf club head body;

a moveable weight member contained internally within the golf club head body so that the moveable weight member is not exposed; and a track system contained internally within the golf club head body so that the track system is not exposed, wherein the track system includes a track which extends around the interior of one or more walls that comprise the golf club head body, wherein the moveable weight member is configured to be moved around the interior of the golf club head by sliding in the track, wherein the track extends from a heel side of the golf club head body along a rear side of the golf club head body to a toe side of the golf club head body, wherein the track is positioned on or in the interior wall or walls that comprise the heel, toe and rear sides of the golf club head body, wherein the moveable weight member is moveable from a position in the heel side to a position in the rear side to a position in the toe side of the golf club head body, wherein the track does not extend along a sole of the golf club head body but along the side of a head between a crown and the sole, wherein adjusting the moveable weight member is done from within a main hollow cavity of the head body during which the moveable weight member is not exposed outside from the side of the head body between the crown and the sole.

14. The golf club according to claim 13, wherein the track slopes downwardly from a ball striking face side of the golf club head body to the rear side of the golf club head body, wherein a portion of the track that extends along the rear side of the golf club head body is at a height lower than portions of the track that extend along the heel side and toe side of the golf club head body.

15. The golf club according to claim 13, wherein the moveable weight member includes a locking mechanism which allows the moveable weight member to be locked in a particular position along the track.

16. The golf club according to claim 13, wherein the moveable weight member is shaped to correspond to the shape of the walls that comprise the golf club head body and exhibits at least of a U-shape or C-shape which faces a center of the golf club head body.

17. The golf club according to claim 13, wherein the moveable weight member does not directly contact with an exterior wall of the golf club head.

* * * * *